US012479552B1

(12) United States Patent
Novak et al.

(10) Patent No.: US 12,479,552 B1
(45) Date of Patent: Nov. 25, 2025

(54) COPILOT DEVICES AND LOCKING MECHANISMS FOR MARINE DRIVES

(71) Applicant: Brunswick Corporation, Mettawa, IL (US)

(72) Inventors: Aaron J. Novak, North Fond du Lac, WI (US); Jeremy J. Kraus, Mt. Calvary, WI (US)

(73) Assignee: Brunswick Corporation, Mettawa, IL (US)

( * ) Notice: Subject to any disclaimer, the term of this patent is extended or adjusted under 35 U.S.C. 154(b) by 598 days.

(21) Appl. No.: 17/960,623

(22) Filed: Oct. 5, 2022

(51) Int. Cl.
*B63H 20/02* (2006.01)
*B63H 20/12* (2006.01)

(52) U.S. Cl.
CPC ..... *B63H 20/02* (2013.01); *B63H 20/12* (2013.01)

(58) Field of Classification Search
CPC ..... B63H 20/02; B63H 20/12
See application file for complete search history.

(56) References Cited

U.S. PATENT DOCUMENTS

| | | | |
|---|---|---|---|
| 1,451,452 | A | 4/1923 | Totten |
| 2,549,481 | A | 4/1951 | Kiekhaefer |
| 2,808,218 | A | 10/1957 | Steller |
| 2,914,020 | A | 11/1959 | Van Raden |
| 3,922,996 | A | 12/1975 | Meyer |
| 3,961,595 | A | 6/1976 | Meyer |
| 4,018,104 | A | 4/1977 | Bland et al. |
| 4,521,201 | A | 6/1985 | Watanabe |
| 4,666,410 | A | 5/1987 | Anselm |
| 4,701,141 | A | 10/1987 | Sumigawa |
| 5,102,357 | A | 4/1992 | Bruesch et al. |
| 5,180,319 | A | 1/1993 | Shiomo et al. |
| 5,340,342 | A | 8/1994 | Boda et al. |
| 5,582,527 | A | 12/1996 | Nakamura |
| 6,053,471 | A | 4/2000 | Brown |
| 6,146,221 | A | 11/2000 | Natsume |

(Continued)

FOREIGN PATENT DOCUMENTS

| | | |
|---|---|---|
| CN | 206590092 | 10/2017 |
| EP | 1101696 | 5/2001 |

(Continued)

OTHER PUBLICATIONS

Jun. 29, 2022 Declaration of Prior Art submitted in U.S. Appl. No. 17/852,944.

(Continued)

*Primary Examiner* — Stephen P Avila
(74) *Attorney, Agent, or Firm* — Andrus Intellectual Property Law, LLP

(57) ABSTRACT

An apparatus for removably supporting a marine drive on a marine vessel. The apparatus has a transom bracket assembly having a swivel cylinder, a steering bracket assembly having a swivel tube disposed in and steerable relative to the swivel cylinder, and a locking mechanism configured to retain the swivel tube in the swivel cylinder. A return spring has a spring force sufficient to move the swivel tube outwardly relative to the swivel cylinder when a locking arm is moved from the locked position to the unlocked position. A copilot device is configured to restrain rotation of the swivel tube relative to the transom bracket. The copilot device is disposed at least partially in the swivel tube.

19 Claims, 17 Drawing Sheets

(56) References Cited

U.S. PATENT DOCUMENTS

| | | | | |
|---|---|---|---|---|
| 6,174,211 | B1 | 1/2001 | Nakamura | |
| 6,283,806 | B1 | 9/2001 | Schmidt et al. | |
| 6,402,577 | B1 | 6/2002 | Treinen | |
| 6,659,817 | B1 | 12/2003 | Anderson et al. | |
| 6,902,450 | B2 | 6/2005 | Ohtsuki et al. | |
| 7,048,600 | B1 | 5/2006 | Broussard | |
| 7,090,551 | B1 | 8/2006 | Lokken et al. | |
| 7,244,152 | B1 | 7/2007 | Uppgard | |
| 7,297,035 | B2 | 11/2007 | Broussard | |
| 7,303,595 | B1 | 12/2007 | Janitz | |
| 7,311,571 | B1 | 12/2007 | Swan | |
| 7,314,396 | B2 | 1/2008 | Kubota et al. | |
| 7,410,397 | B2 | 8/2008 | Nakamura et al. | |
| 7,681,513 | B1 | 3/2010 | Hundertmark | |
| 7,896,304 | B1 | 3/2011 | Eichinger et al. | |
| 8,069,803 | B1 | 12/2011 | Crawford | |
| 8,795,010 | B1 | 8/2014 | Wiatrowski | |
| 8,820,701 | B1 | 9/2014 | Eichinger | |
| 9,205,906 | B1 | 12/2015 | Eichinger | |
| 9,376,191 | B1 | 6/2016 | Jaszewski | |
| 9,463,859 | B1 | 10/2016 | Cooper, III et al. | |
| 9,481,434 | B1 | 11/2016 | Eichinger et al. | |
| 9,616,986 | B1 | 4/2017 | Gilk et al. | |
| 9,623,946 | B2 | 4/2017 | Delise | |
| 9,643,703 | B1 | 5/2017 | Eichinger | |
| 9,701,383 | B1 | 7/2017 | Stuber et al. | |
| 9,764,813 | B1 | 9/2017 | Zarembka et al. | |
| 9,776,699 | B1 | 10/2017 | Alby | |
| 9,783,278 | B1 | 10/2017 | Dannenberg et al. | |
| 9,789,945 | B1 | 10/2017 | Vaninetti et al. | |
| 9,963,213 | B1 | 5/2018 | Jaszewski et al. | |
| 9,969,475 | B1 | 5/2018 | Waisanen | |
| 10,005,536 | B2 | 6/2018 | Fukuchi et al. | |
| 10,124,871 | B1 | 11/2018 | Eichinger et al. | |
| 10,246,173 | B1 | 4/2019 | Ingebritson et al. | |
| 10,464,648 | B1 | 11/2019 | Amerling et al. | |
| 10,696,367 | B1 | 6/2020 | Ingebritson et al. | |
| 10,787,236 | B1 | 9/2020 | Erickson et al. | |
| 11,066,140 | B1 | 7/2021 | Huffer et al. | |
| 11,097,824 | B1 | 8/2021 | Anderson, Jr. | |
| 11,866,137 | B1 | 1/2024 | Jaszewski | |
| 2009/0001244 | A1 | 1/2009 | Lucier et al. | |
| 2009/0170384 | A1 | 7/2009 | Balogh et al. | |
| 2011/0065340 | A1 | 3/2011 | Klawitter et al. | |
| 2012/0094559 | A1* | 4/2012 | Takase | B63H 20/06 440/61 S |
| 2013/0316603 | A1 | 11/2013 | Hagi | |
| 2019/0344873 | A1 | 11/2019 | Kimpara | |
| 2021/0394882 | A1 | 12/2021 | Waldvogel | |
| 2023/0102741 | A1 | 3/2023 | Fergus | |
| 2023/0192260 | A1 | 6/2023 | Dannenberg et al. | |
| 2023/0257095 | A1 | 8/2023 | Waldvogel | |
| 2024/0051650 | A1 | 2/2024 | Nickols | |

FOREIGN PATENT DOCUMENTS

| | | |
|---|---|---|
| EP | 4155191 | 3/2003 |
| JP | 85654697 | 5/1981 |
| JP | 66479000 | 3/1989 |
| JP | 3976290 | 9/2007 |
| JP | 2021006428 A | 1/2021 |
| WO | 2022045986 | 3/2022 |

OTHER PUBLICATIONS

Evinrude, Evinrude E30DTSLAFD Tiller Arm Diagram, last accessed May 11, 2021, available at: https://www.boats.net/catalog/evinrude/outboard-by-year/af-models/e30dtslafd/tiller-arm.

Evinrude, Evinrude E-Tec 25 HP, last accessed May 11, 2021, available at: https://www.evinrude.com/en-US/e-tec/etec-full-specs.html#tab=12.

Fergus, Ryan A., Unpublised U.S. Appl. No. 17/487,116, "Outboard Motor That Is Removable From Transom Clamp Bracket", Sep. 28, 2021.

Honda Marine, Honda BF25-30hp Outboard Engines, last accessed May 11, 2021, available at: https://marine.honda.com/outboards/motor-detail/BF25-30#specs.

Honda Marine, Honda Marine BF25DK3 SHGA S/N: BATJ-1501086 Parts List, last accessed Dec. 4, 2018, available at: http://peparts.honda.com/marine#/serial.

Honda Motor Co., Ltd., BF25D-BF30D Owner's Manual, 2017.

Mercury Marine, 2010 Mercury Marine 25/30 EFI FourStroke Owner's Manual.

Mercury Marine, 2015 Mercury Marine 15/20 FourStroke Outboard Installation Operation Maintenance Warranty Manual.

PPF Mud Motors, "PPF Wood Duck 6.5 HP Mud Motor," screenshot from photo gallery, admitted prior art, last accessed Jul. 5, 2021, available at https://ppfmudmotors.com/gallery/#swipebox.

PPF Mud Motors, "Quick Drop Transom Mount," website, available at least as early as Sep. 15, 2017, last accessed Jul. 5, 2021, available at http://ppfmudmotors.com/quick-drop-transom-mount/—this is the webpage screenshot.

Remigo, E-Outboard, webpage and 5 photographs, Sep. 26, 2020, available at https://web.archive.org/web/20200926115717/https://remigo.eu/.

Suzuki Motor Corporation, DF25A-DF30A Owner's Manual, Oct. 2015.

Suzuki Motor Corporation, Suzuki DF 30A Parts Listings—2018, last accessed Dec. 4, 2018, available at: https://www.brownspoint.com/store/pc/BP_AP_AssemblyDetail.asp?ID=19761.

Schrank et al., "Integrated Copilot and Locking Mechanism for Marine Drives," Unpublished U.S. Appl. No. 17/509,739, filed Oct. 25, 2021 (drawings, specification, and claims only).

Nickols et al., "Copilot Devices and Apparatuses for Supporting Marine Drives Having a Copilot Device," Unpublished U.S. Appl. No. 17/852,944, filed Jun. 29, 2022 (drawings, specification, and claims only).

Yamaha Motor Co., Ltd., 2013 Yamaha Outboard 30hp—F30LA Steering Friction Section, last accessed Dec. 4, 2018, available at: https://www.crowleymarine.com/yp/KE329296/steering-friction-f30la-2013-30hp.

Yamaha Motor Co., Ltd., 2013 Yamaha Outboard 30hp—F30LA, Bracket 1 Section, last accessed Dec. 4, 2018, available at: crowleymarine.com.

Yamaha Motor Co., Ltd., Yamaha F25 T25 Owner's Manual, May 2013.

Yamaha Motor Co., Ltd., Yamaha F25SMHC—2006 and Later, Parts List, last accessed Dec. 4, 2018, available at: https://shop.yamahaonlineparts.com/OEMpartfinder.htm.

Yamaha Motor Co., Ltd., Yamaha 30hp Co-Pilot Manual, Feb. 2010.

Unpublished U.S. Appl. No. 17/509,739, "Integrated Copilot and Locking Mechanism for Marine Drives". Oct. 25, 2021.

Unpublished U.S. Appl. No. 17/852,944, "Copilot Devices and Apparatuses for Supporting Marine Drives Having a Copilot Device". Jun. 29, 2022.

Office Action issued in U.S. Appl. No. 17/960,614, dated Jun. 18, 2025.

* cited by examiner

COPILOT DEVICES AND LOCKING MECHANISMS FOR MARINE DRIVES

FIELD

The present disclosure relates to apparatuses for removably supporting a steerable marine drive on a marine vessel. The disclosure further relates to copilot devices and locking mechanisms for such apparatuses.

BACKGROUND

The following U.S. Patents and Patent Applications are incorporated herein by reference:

U.S. Pat. No. 9,205,906 discloses a mounting arrangement for supporting an outboard motor with respect to a marine vessel extending in a fore-aft plane. The mounting arrangement comprises first and second mounts that each have an outer shell, an inner wedge concentrically disposed in the outer shell, and an elastomeric spacer between the outer shell and the inner wedge. Each of the first and second mounts extend along an axial direction, along a vertical direction that is perpendicular to the axial direction, and along a horizontal direction that is perpendicular to the axial direction and perpendicular to the vertical direction. The inner wedges of the first and second mounts both have a non-circular shape when viewed in a cross-section taken perpendicular to the axial direction. The non-circular shape comprises a first outer surface that extends transversely at an angle to the horizontal and vertical directions. The non-circular shape comprises a second outer surface that extends transversely at a different, second angle to the horizontal and vertical directions. A method is for making the mounting arrangement.

U.S. Pat. No. 9,701,383 discloses a marine propulsion support system having a transom bracket, a swivel bracket, and a mounting bracket. A drive unit is connected to the mounting bracket by a plurality of vibration isolation mounts, which are configured to absorb loads on the drive unit that do not exceed a mount design threshold. A bump stop located between the swivel bracket and the drive unit limits deflection of the drive unit caused by loads that exceed the threshold. An outboard motor includes a transom bracket, a swivel bracket, a cradle, and a drive unit supported between first and second opposite arms of the cradle. First and second vibration isolation mounts connect the first and second cradle arms to the drive unit, respectively. An upper motion-limiting bump stop is located remotely from the vibration isolation mounts and between the swivel bracket and the drive unit.

U.S. Pat. No. 9,764,813 discloses a tiller for an outboard motor. The tiller comprises a tiller body that is elongated along a tiller axis between a fixed end and a free end. A throttle grip is disposed on the free end. The throttle grip is rotatable through a first (left handed) range of motion from an idle position in which the outboard motor is controlled at idle speed to first (left handed) wide open throttle position in which the outboard motor is controlled at wide open throttle speed and alternately through a second (right handed) range of motion from the idle position to a second (right handed) wide open throttle position in which the outboard motor is controlled at wide open throttle speed.

U.S. Pat. No. 11,097,824 discloses an apparatus for steering an outboard motor with respect to a marine vessel. The apparatus includes a transom bracket configured to support the outboard motor with respect to the marine vessel; a tiller for manually steering the outboard motor with respect to a steering axis; a steering arm extending above the transom bracket and coupling the tiller to the outboard motor such that rotation of the tiller causes rotation of the outboard motor with respect to the steering axis, wherein the steering arm is located above the transom bracket; and a copilot device configured to lock the outboard motor in each of a plurality of steering positions relative to the steering axis. The copilot device extends above and is manually operable from above the steering arm.

U.S. patent application Ser. No. 17/487,116 discloses an outboard motor including a transom clamp bracket configured to be supported on a transom of a marine vessel and a swivel bracket configured to be supported by the transom clamp bracket. A propulsion unit is supported by the swivel bracket, the propulsion unit comprising a head unit, a midsection below the head unit, and a lower unit below the midsection. The head unit, midsection, and lower unit are generally vertically aligned with one another when the outboard motor is in a neutral tilt/trim position. The propulsion unit is detachable from the transom clamp bracket.

U.S. patent application Ser. No. 17/509,739 discloses an apparatus for removably supporting a marine drive on a marine vessel. The apparatus has a transom bracket assembly for mounting to the marine vessel, a steering bracket for coupling the marine drive to the transom bracket assembly so the marine drive is steerable relative to the transom bracket assembly and the marine vessel; and an integrated copilot and locking mechanism configured to retain the steering bracket in a plurality of steering orientations. The mechanism is further configured to lock and alternately unlock the steering bracket relative to the transom bracket assembly such that in a locked position the marine drive is retained on the transom bracket assembly and such that in an unlocked position the marine drive is removable from the transom bracket assembly.

SUMMARY

This Summary is provided to introduce a selection of concepts that are further described herein below in the Detailed Description. This Summary is not intended to identify key or essential features of the claimed subject matter, nor is it intended to be used as an aid in limiting scope of the claimed subject matter.

In non-limiting examples disclosed herein, an apparatus may be configured for removably supporting a marine drive on a marine vessel. The apparatus may include a transom bracket assembly having a swivel cylinder and a steering bracket assembly. The steering bracket assembly may have a swivel tube disposed in and steerable relative to the swivel cylinder through a steering range, and the steering range may be delimited by opposing steering stops. The transom bracket assembly may include an annular mouth which may be configured so that as the swivel tube is inserted into the swivel cylinder, the steering bracket assembly operably engages the annular mouth and is thereby caused to rotate into alignment with the steering range.

In non-limiting examples, the swivel tube may define a steering axis for the marine drive, wherein the steering range extends only part way about the steering axis. The annular mouth may comprise a ramped surface which is engaged by the steering bracket assembly as the swivel tube is inserted into the swivel cylinder, wherein engagement between the steering bracket assembly and the ramped surface causes the steering bracket assembly to rotate into alignment with the steering range. The steering bracket assembly may comprise an engagement member which engages and slides along the ramped surface as the swivel tube is inserted into the swivel cylinder, which thereby causes the steering bracket assembly to rotate into alignment with the steering range.

In non-limiting examples, the steering bracket assembly may comprise a steering arm extending from the marine drive and the swivel tube extends transversely from the steering arm and defines a steering axis for the marine drive. The steering bracket assembly may comprise an engagement member which extends transversely from the steering arm and is spaced apart from the swivel tube, wherein the engagement member is configured to engage the annular mouth as the swivel tube is inserted into the swivel cylinder, which thereby causes the steering bracket assembly to rotate about the steering axis into alignment with the steering range. Once the swivel tube is fully inserted into the swivel cylinder the engagement member may be configured to thereafter engage the opposing steering stops which prevents steering of the marine drive beyond the steering range. The opposing steering stops may comprise end surfaces located about the mouth, wherein steering of the marine drive in a first direction about the steering axis brings the engagement member into abutment with a first one of the end surfaces, and wherein steering of the marine drive in an opposite, second direction about the steering axis brings the engagement member into abutment with a second one of the end surfaces.

In non-limiting examples, the apparatus may further comprise a locking mechanism configured to retain the swivel tube in the swivel cylinder, wherein the locking mechanism extends through the body of the annular mouth. The locking mechanism may comprise a locking arm which extends through the body of the annular mouth, the locking arm being movable into a locked position in which the locking arm prevents removal of the swivel tube from the swivel cylinder, and an unlocked position in which the locking arm permits removal of the swivel tube from the swivel cylinder. The locking arm may extend through the body of the annular mouth below and between the diametrically opposing ramped surfaces. The locking arm may have an inner end which operably engages the swivel tube and prevents removal of the swivel tube from the swivel cylinder, and further comprise a lock spring providing a spring force which biases the locking arm into the locked position. A return spring may be configured to provide a spring force which biases the swivel tube outwardly relative to the swivel cylinder, wherein the spring force is sufficient to bias the swivel tube outwardly relative to the swivel cylinder, in particular such that moving the locking arm into the unlocked position permits the return spring to move the swivel tube outwardly relative to the swivel cylinder a distance sufficient to move the flange past the locking arm.

In non-limiting examples disclosed herein, an apparatus may be configured for removably supporting a marine drive on a marine vessel. The apparatus may include a transom bracket assembly having a swivel cylinder, a steering bracket assembly having a swivel tube disposed in and steerable relative to the swivel cylinder, and a locking mechanism configured to retain the swivel tube in the swivel cylinder. The locking mechanism may include a locking arm which overlaps a flange on the swivel tube in a locked position to thereby prevent removal of the steering bracket assembly from the transom bracket assembly, and which is withdrawn from the flange in an unlocked position to thereby permit removal of the steering bracket assembly from the transom bracket assembly. A return spring may have a spring force sufficient to move the swivel tube outwardly relative to the swivel cylinder when the locking arm is moved from the locked position to the unlocked position.

In non-limiting examples disclosed herein, an apparatus may be configured for removably supporting a marine drive on a marine vessel. The apparatus may include a transom bracket assembly having a swivel cylinder, a steering bracket assembly having a swivel tube disposed in and steerable relative to the swivel cylinder, and a copilot device configured to restrain rotation of the swivel tube relative to the transom bracket, wherein the copilot device is disposed at least partially in the swivel tube.

In non-limiting examples disclosed herein, an apparatus may be configured for removably supporting a marine drive on a marine vessel. The apparatus may include a transom bracket assembly having a swivel cylinder, a steering bracket assembly having a swivel tube disposed in and steerable relative to the swivel cylinder, and a locking mechanism configured to retain the swivel tube in the swivel cylinder. The locking mechanism may include a locking arm which overlaps a flange on the swivel tube in a locked position to thereby prevent removal of the steering bracket assembly from the transom bracket assembly, and which is withdrawn from the flange in an unlocked position to thereby permit removal of the steering bracket assembly from the transom bracket assembly. A return spring may have a spring force sufficient to move the swivel tube outwardly relative to the swivel cylinder when the locking arm is moved from the locked position to the unlocked position. A copilot device may be configured to restrain rotation of the swivel tube relative to the transom bracket, wherein the copilot device is disposed at least partially in the swivel tube.

In non-limiting examples, the steering bracket assembly may comprise a steering arm, wherein the swivel tube comprises a lower end disposed in the swivel cylinder and an upper end coupled to the steering arm, and wherein the copilot device protrudes from an upper end of the swivel tube. The apparatus may comprise a handle for actuating the copilot device, the handle being located at the upper end of the swivel tube.

In non-limiting examples, the copilot device may protrude from a lower end of the swivel tube and comprise a sleeve on the swivel tube, the sleeve being rotatable about the swivel tube, rotationally locked relative to the swivel cylinder. A friction member and an actuator may be provided for moving the sleeve against the friction member, which thereby frictionally engages and restrains rotation of the swivel tube relative to the sleeve. The actuator may comprise an actuator arm which extends through the swivel tube, the actuator arm having an upper end and a lower end, wherein the lower end is disposed in the swivel cylinder.

The actuator may comprise a nut on an end of the actuator arm, the nut being engaged with the actuator arm via a threaded connection such that rotation of the actuator arm in a first direction causes the nut to axially travel along the actuator arm in a first direction and such that rotation of the actuator arm in an opposite, second direction causes the nut to axially travel along the actuator arm in an opposite, second direction. Rotation of the actuator arm in the first direction causes the nut to slide the sleeve along the swivel tube so as to engage the friction member against the swivel tube, thereby restraining rotation of the swivel tube in the swivel cylinder, and rotation of the actuator arm in the opposite, second direction causes the nut to permit the sleeve to slide along the swivel tube so as to disengage the friction member from the swivel tube, thereby permitting rotation of the swivel tube in the swivel cylinder.

BRIEF DESCRIPTION OF THE DRAWINGS

Examples are described with reference to the following drawing figures. The same numbers are used throughout to reference like features and components.

DETAILED DESCRIPTION

During research and development in the field of marine propulsion devices, the present inventors determined that the process of installing a marine drive on a transom bracket can be difficult as multiple features on the marine drive need to be aligned with corresponding features on the transom bracket assembly. For example, to install an outboard motor, a user must align a rotatable bearing with corresponding features on the swivel bracket while simultaneously aligning a steering pin between steering stops. Aligning these features can be awkward and difficult while lifting the weight of the marine drive. Through their research and experimentation, the present inventors determined that it would be advantageous to provide an apparatus for supporting a marine drive on marine vessel that self-aligns any mounting features so that the marine drive can be inserted in any orientation, thereby reducing the chance of user error, limiting the chance of accidentally damaging the marine drive, and enhancing overall user experience. During research and development in the field of marine propulsion devices, the present inventors additionally determined it would be advantageous to provide improved locking apparatuses for removably coupling a marine drive to a marine vessel. Further, the present inventors determined it would be advantageous to provide improved copilot apparatuses for selectively retaining the marine drive in various steering orientations. The present disclosure is a result of the present inventors' efforts in this regard.

Figure 1:
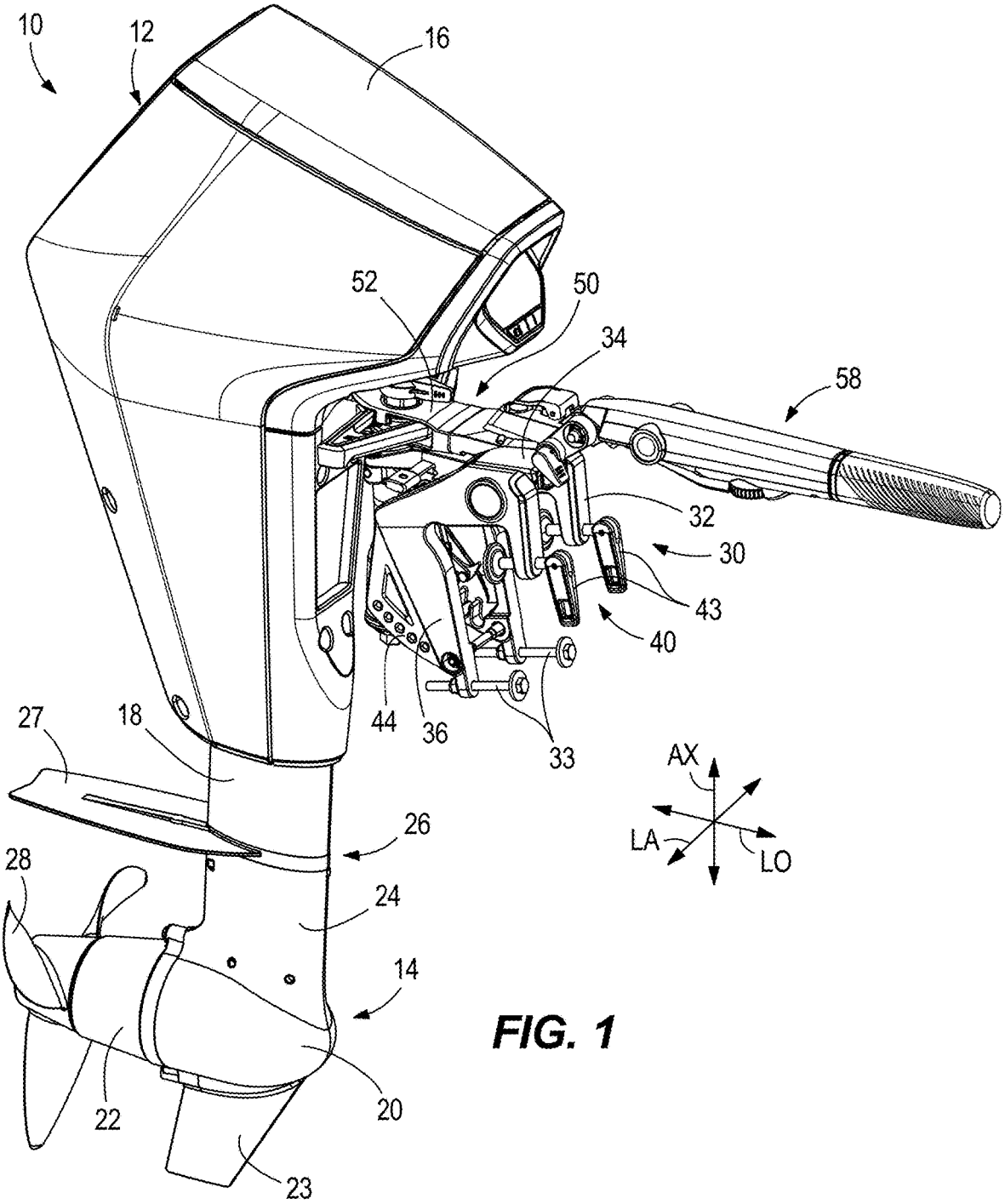
FIG. 1 is a side perspective view of a marine drive supported on a transom bracket assembly configured for supporting the marine drive on the transom of a marine vessel.
Figure 2:
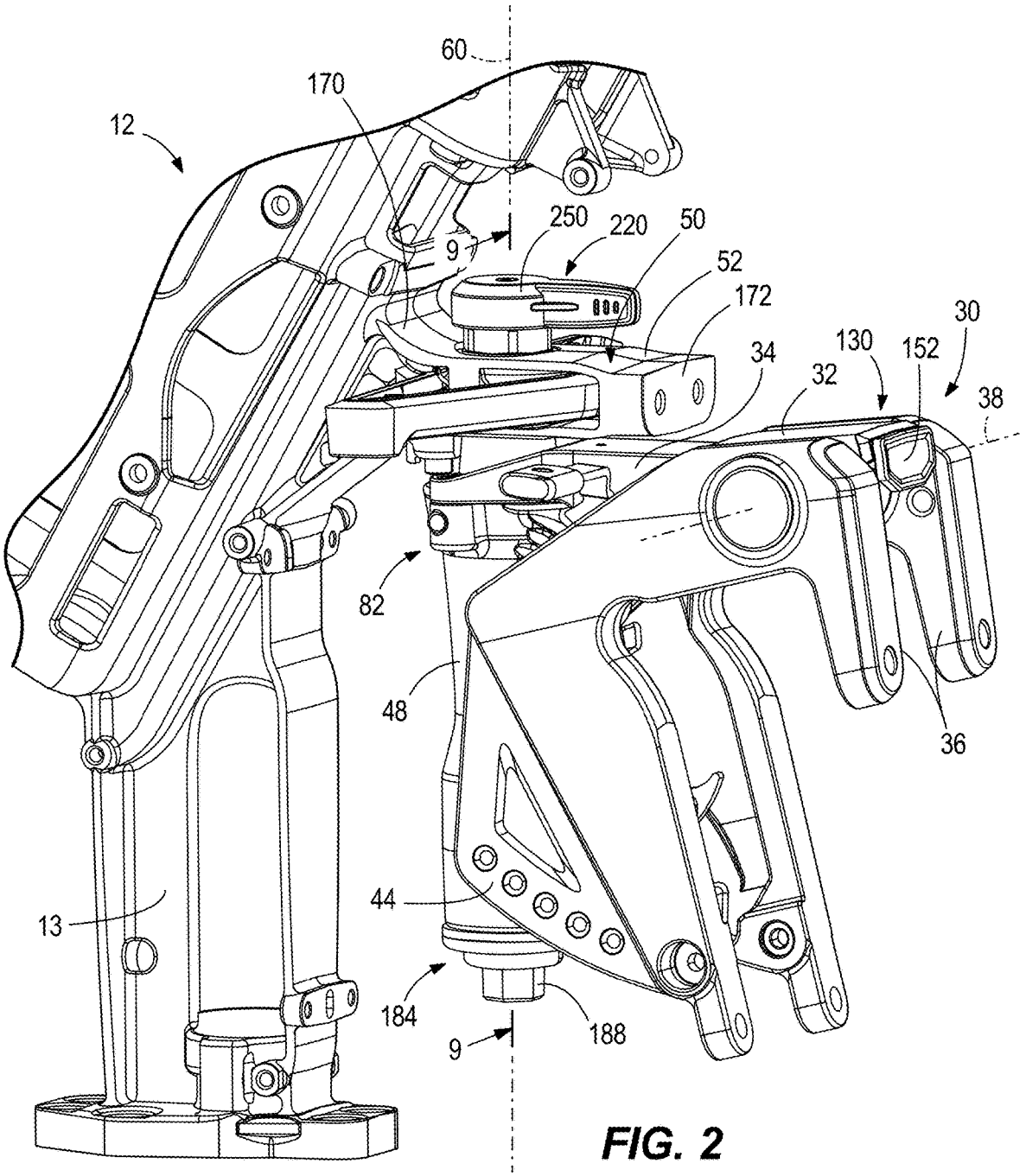
FIG. 2 is a detailed perspective view of the marine drive and transom bracket assembly of FIG. 1.
Figure 3:
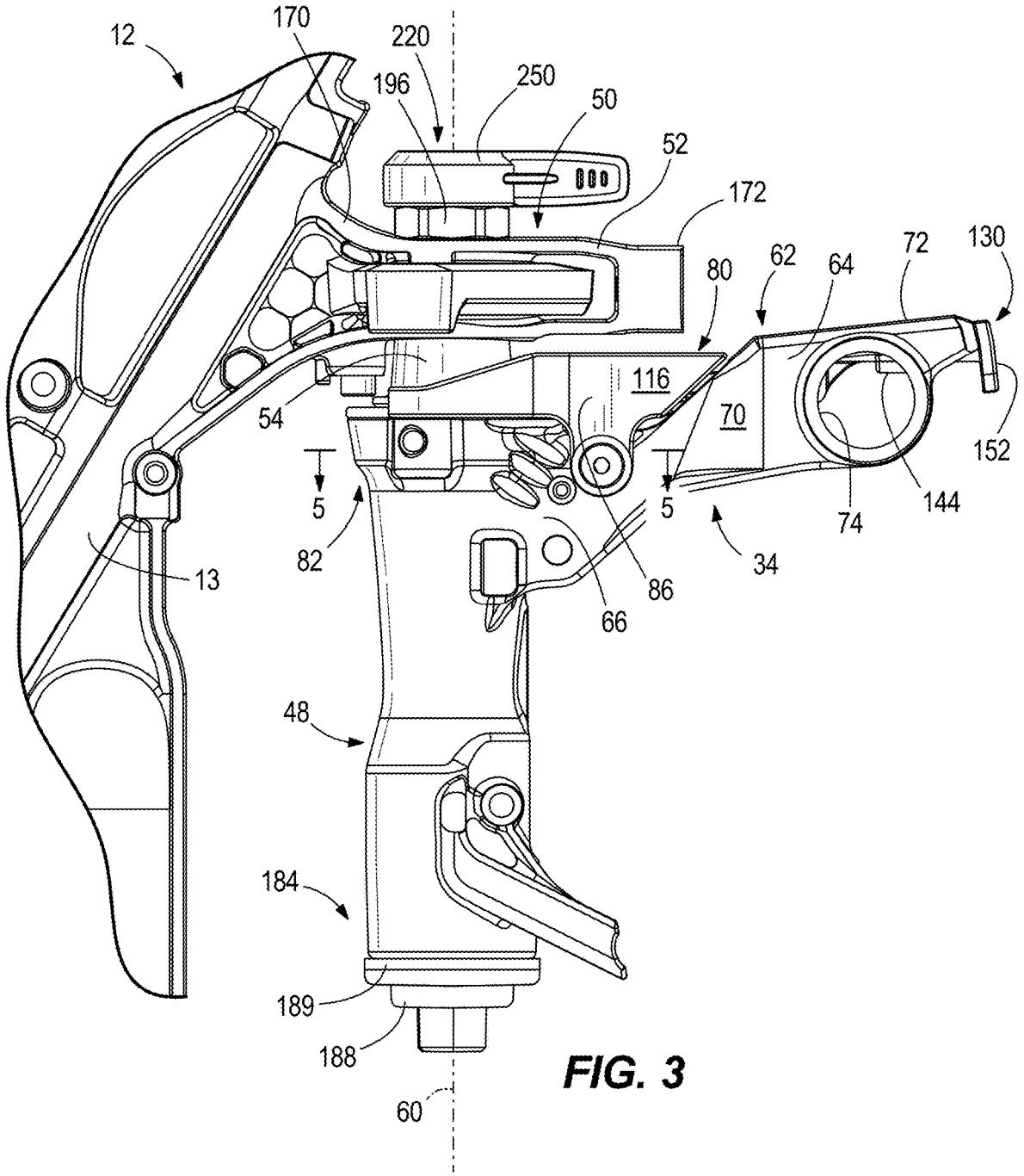
FIG. 3 is a side view of the marine drive supported on the swivel bracket of the transom bracket assembly of FIG. 2.

FIGS. 1-3 depict a marine drive 10 for propelling a marine vessel in a body of water. In the illustrated embodiment, the marine drive 10 extends from top to bottom in an axial direction AX, from front to back in a longitudinal direction LO which is perpendicular to the axial direction AX, and from side to opposite side in a lateral direction LA which is perpendicular to the axial direction AX and perpendicular to the longitudinal direction LO. A transom bracket assembly 30 supports the marine drive 10 on the transom (not shown) of the marine vessel such that the drive assembly 12 is trimmable up and down relative to the transom bracket assembly 30, including in non-limiting examples wherein the drive assembly 12 is raised completely out of the water.

The drive assembly 12 includes a supporting frame 13 for rigidly supporting the various components of the marine drive 10 with respect to the marine vessel and a torpedo housing 14 secured to the supporting frame 13. A cowling 16 is fixed to and surrounds most or all of the supporting frame 13. The cowling 16 defines a cowling interior in which a portion of the supporting frame 13 is enclosed and various components of the marine drive 10 are disposed. The marine drive 10 includes an extension leg 18 which is coupled to the supporting frame 13 and extends downwardly to the torpedo housing 14. The torpedo housing 14 has a front housing portion 20 and a rear housing portion 22 which are mated together and define a watertight lower housing cavity. The front housing portion 20 has a nosecone with a smooth outer surface which transitions to an upwardly extending stem 24 and a downwardly extending skeg 23. An anti-ventilation plate 26 is positioned between the extension leg 18 and the stem 24 and includes a flat tail 27 that extends rearwardly from the extension leg 18. A conventional propulsor 28 is mounted on the outer end of a propulsor shaft extending from the torpedo housing 14 such that rotation of the propulsor shaft causes rotation of the propulsor 28, which in turn generates a thrust force for propelling the marine vessel in water. It should be understood that the various components described above are exemplary and could vary from what is shown With continued reference to FIGS. 1-3, the marine drive 10 is coupled to the transom (not shown) of a marine vessel by a transom bracket assembly 30, which in the illustrated example includes a transom bracket 32 configured to be fixed to the transom and a swivel bracket 34 pivotably coupled to the transom bracket 32. The transom bracket 32 has a pair of C-shaped arms 36 which fit over the top of the transom and a pair of threaded, plunger-style clamps 40 which clamp the C-shaped arms 36 to the transom (not shown). Rotation of handles 43 in one direction clamps the transom between the C-shaped arms 36 and plunger-style clamps 40. Rotation of the handles 43 in the opposite direction frees the C-shaped arms 36 for removal from the transom. In some embodiments, the transom bracket 32 is additionally or alternatively fixed to the transom by fasteners 33.

The swivel bracket 34 is pivotable with respect to the C-shaped arms 36 about a pivot shaft that laterally extends through the forward upper ends of the C-shaped arms 36, thereby defining a trim axis 38. Pivoting of the swivel bracket 34 about the pivot shaft trims the marine drive 10 relative to the marine vessel, for example out of and/or back into the body of water in which the marine vessel is operated. A selector bracket 44 having holes is provided on at least one of the C-shaped arms 36. Holes respectively become aligned with a corresponding mounting hole on the swivel bracket 34 at different selectable trim positions for the marine drive 10. A selector pin (not shown) can be manually inserted into the aligned holes to thereby lock the marine drive 10 in place with respect to the trim axis 38.

Figure 4:
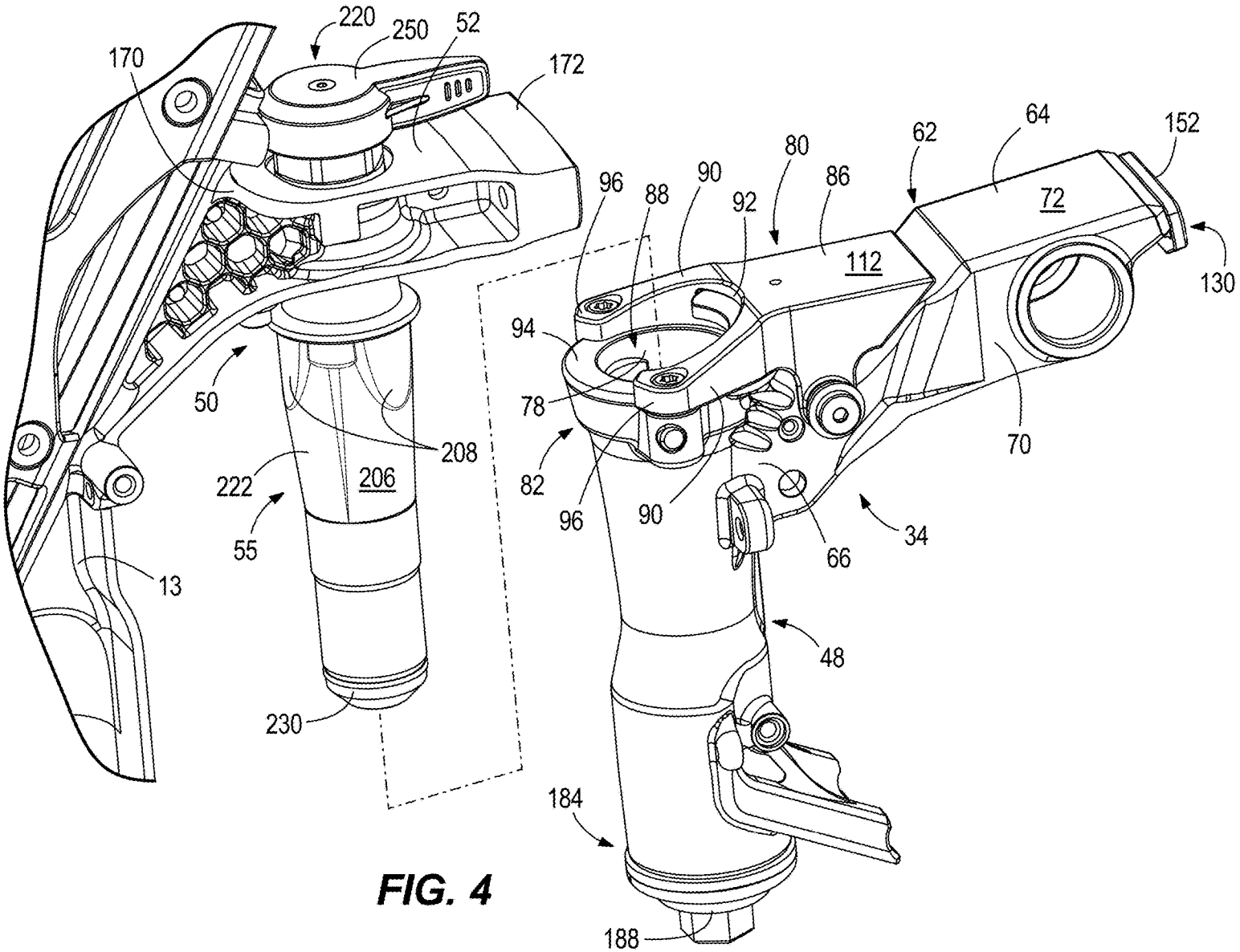
FIG. 4 is an exploded perspective view of the steering bracket assembly and the swivel bracket of FIG. 3.

Referring to FIGS. 2-4, the marine drive 10 is supported on the swivel bracket 34 by a steering bracket assembly 50, which is fixed to and extends from supporting frame 13 of the marine drive 10, generally along the midsection of the marine drive 10. The steering bracket assembly 50 facilitates removable coupling of the marine drive 10 to the transom bracket assembly 30. This may be useful, for example, so that the marine drive 10 is steerable relative to the transom bracket assembly 30 about a steering axis 60 and removable from the transom bracket assembly 30 for transport. The steering bracket assembly 50 includes a steering arm 52 and a swivel tube assembly 55, which extends transversely from the steering arm 52. As illustrated in FIG. 4, the swivel tube assembly 55 is removably received in a swivel cylinder 48 of the swivel bracket 34. Once inserted, the swivel tube 54 is disposed in and steerable relative the swivel cylinder 48 of the swivel bracket 34 through a steering range 260 (see FIG. 18) delimited by opposing steering stops 96 on the transom bracket assembly 30. The marine drive 10 can be steered left or right relative to the marine vessel by rotating about the steering axis 60, which is defined by the swivel tube 54 and swivel cylinder 48, via the tiller 58. The type and configuration of the tiller 58 can vary from what is shown. For example, a marine drive may be configured with an automatic steering system and/or any other known apparatus for steering a marine drive with respect to a marine vessel.

Figure 6:
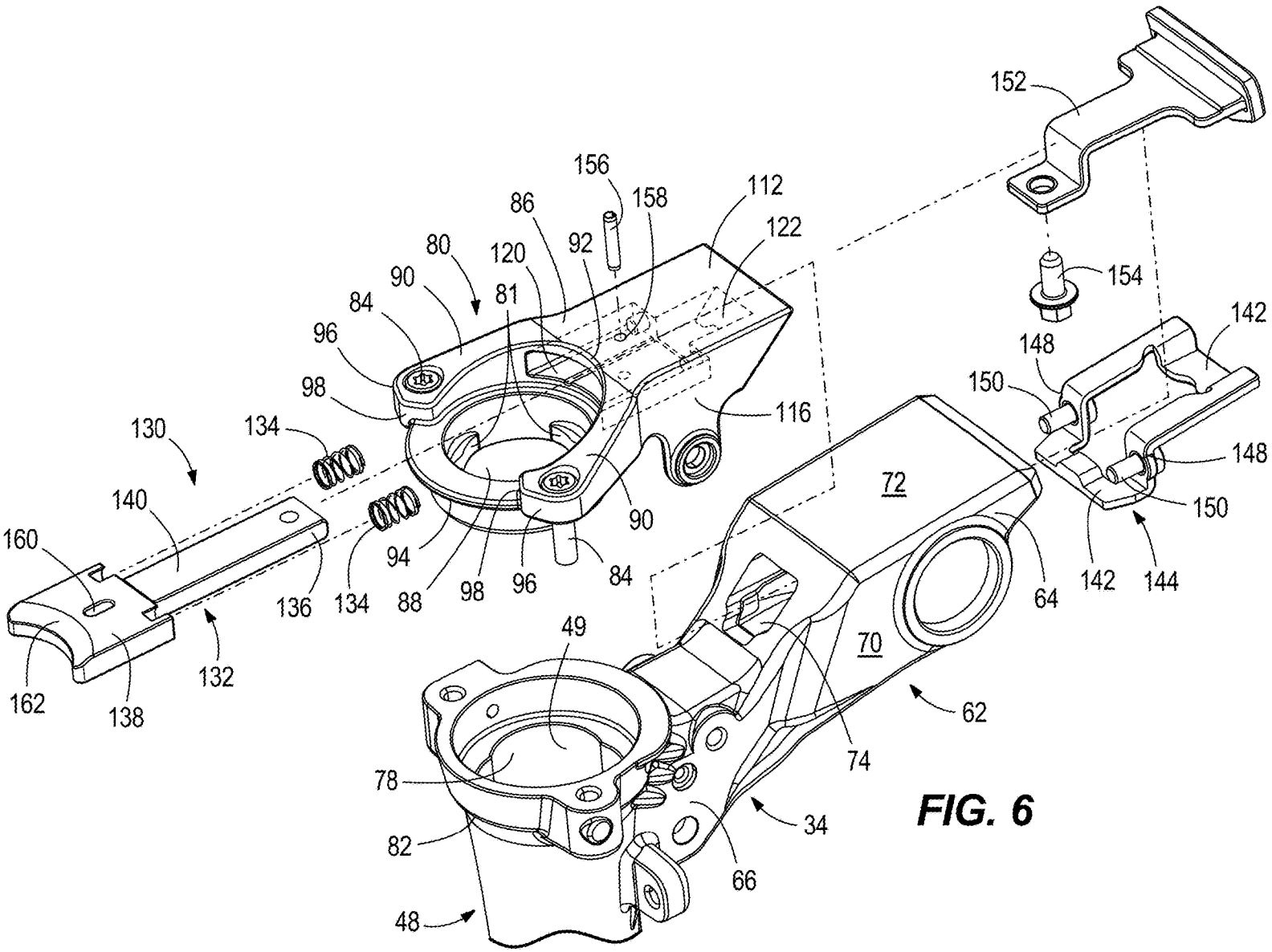
FIG. 6 is an exploded perspective view of the swivel bracket of FIG. 4.
Figure 7:
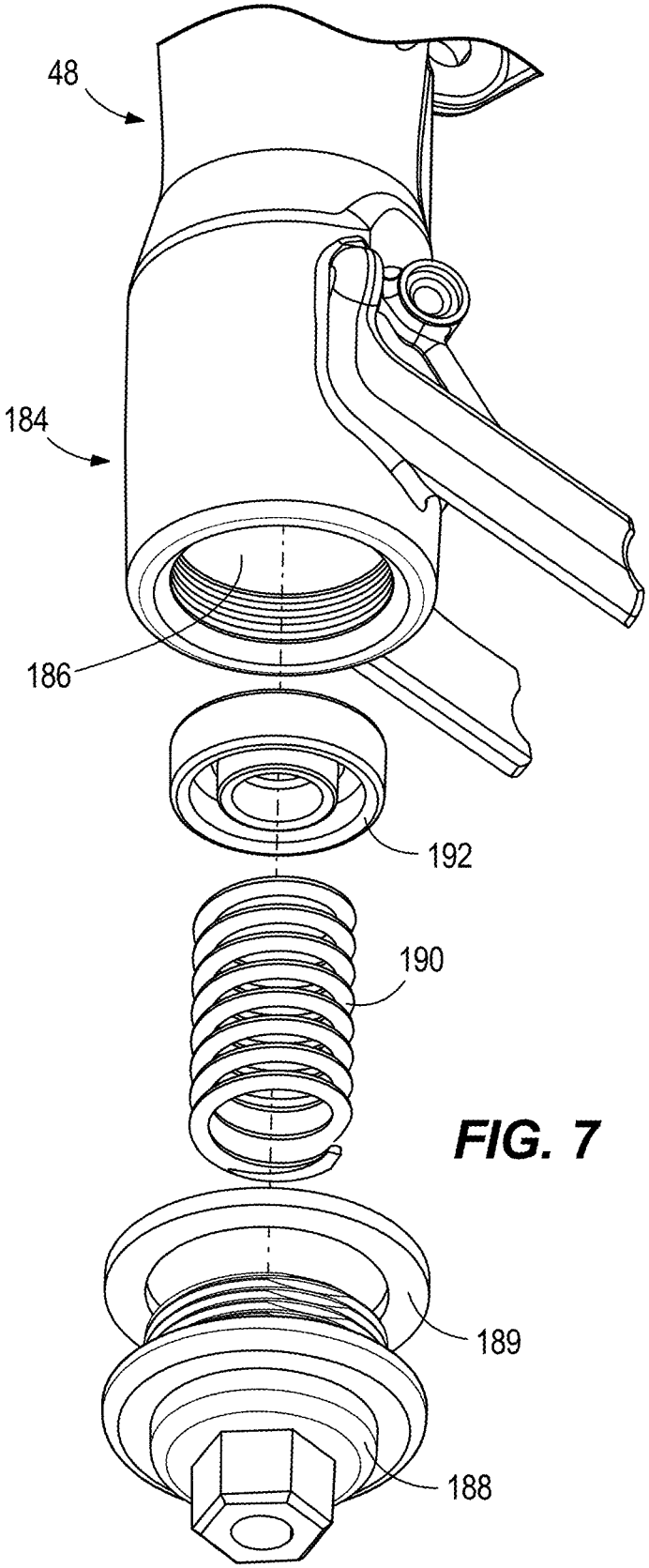
FIG. 7 is an exploded view of the lower end of the swivel cylinder of FIG. 4.
Figure 9:
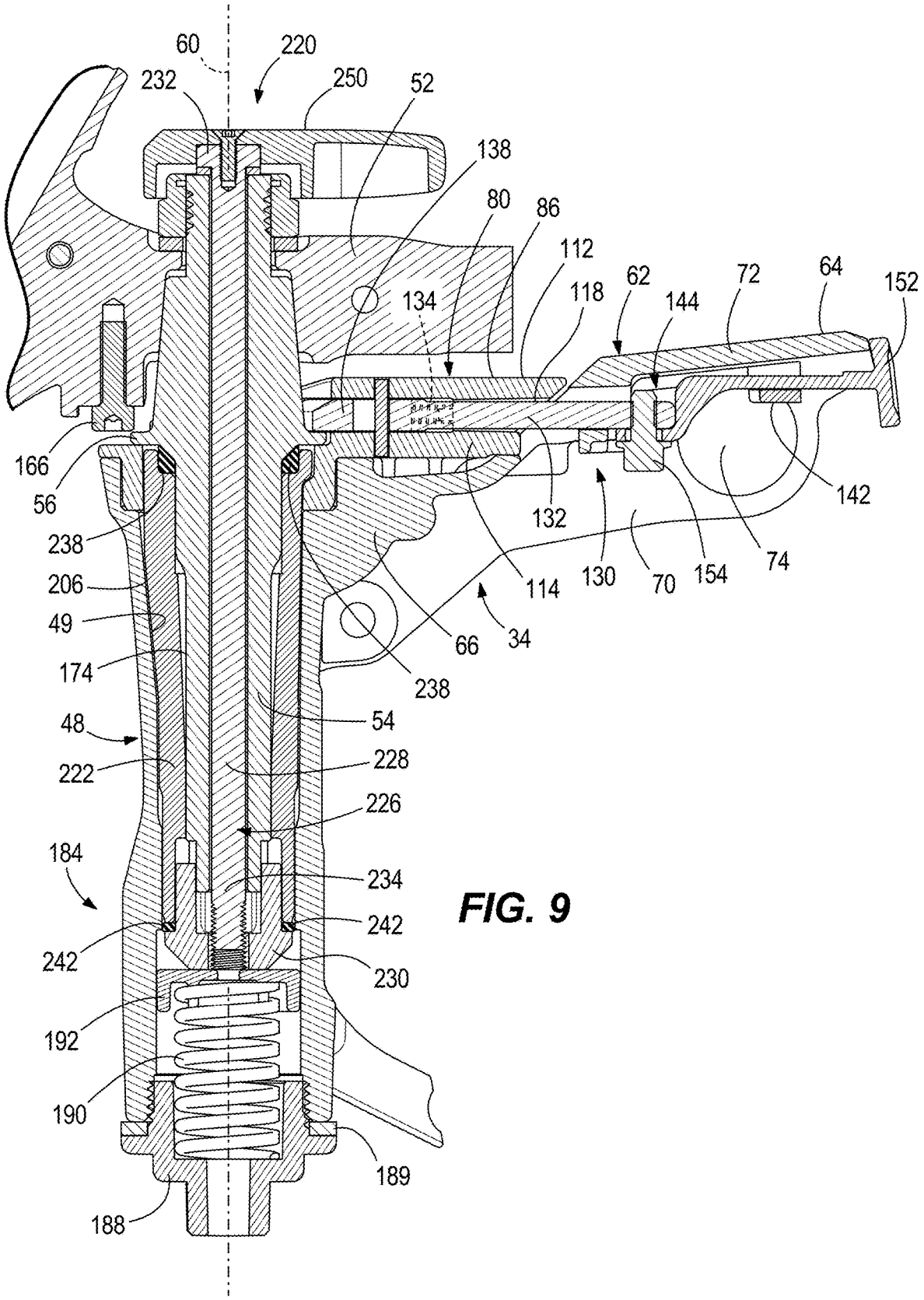
FIG. 9 is a view of section 9-9 taken in FIG. 2 with the locking mechanism in the locked position.
Figure 10:
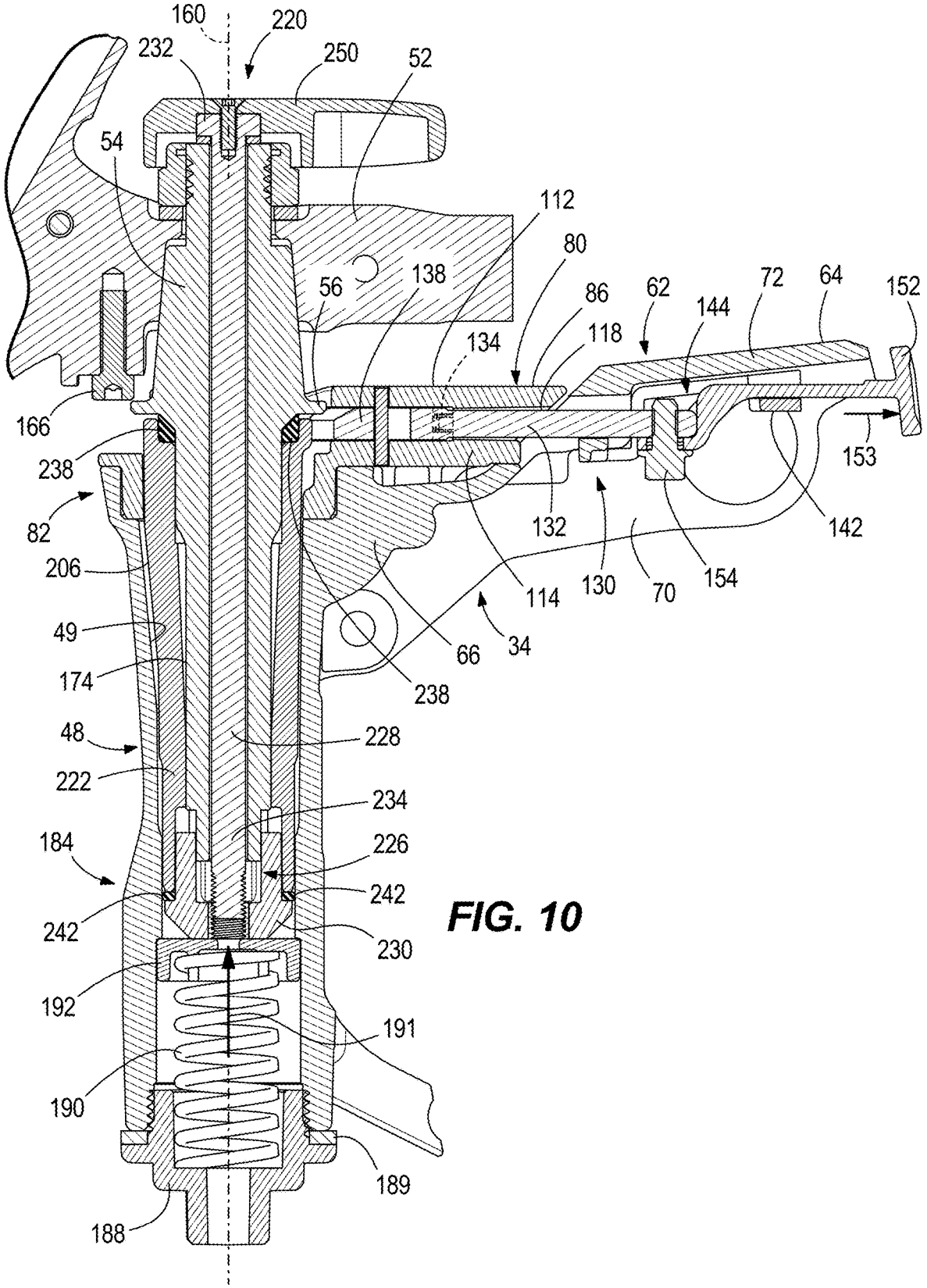
FIG. 10 is another view of section 9-9 with the locking mechanism in the unlocked position.

Referring to FIGS. 4, 6, and 7, the swivel bracket 34 includes a swivel arm 62 having a first end 64 which is pivotably coupled to the C-shaped arms 36 of the transom bracket 32, along the trim axis 38. The swivel arm 62 has an opposite, second end 66 which is fixed to or formed with an elongated swivel cylinder 48. As best shown in FIGS. 6, 9 and 10, the first end 64 of the swivel arm 62 has a pair of sidewalls 70 and a top wall 72 which connects the sidewalls 70. An axial passage 74 is formed through the middle of the swivel arm 62, between the first and second ends 64, 66, and generally next to the top wall 72 and next to and between the sidewalls 70.

The swivel cylinder 48 extends downwardly from the second end 66 of the swivel arm 62 and has an opening 78 at an upper end 82 of the swivel cylinder 48. An annular mouth 80 is nested in the opening 78 is and affixed to the swivel cylinder 48 by fasteners 84. The annular mouth 80 comprises a body 86 having a through-bore 88 for receiving the swivel tube 54. Centering members 81 are spaced around the through-bore 88 and project radially inward to define an eccentric profile that generally matches the inner surface 49 of the swivel cylinder 48. As further detailed below, the centering members 81 and the swivel tube assembly 55 have complementary inner and outer shapes, respectively, and as such are configured so that the swivel tube assembly 55 nests in the annular mouth 80 as the swivel tube assembly 55 is lowered into and seated in the swivel cylinder 48.

Figure 18:
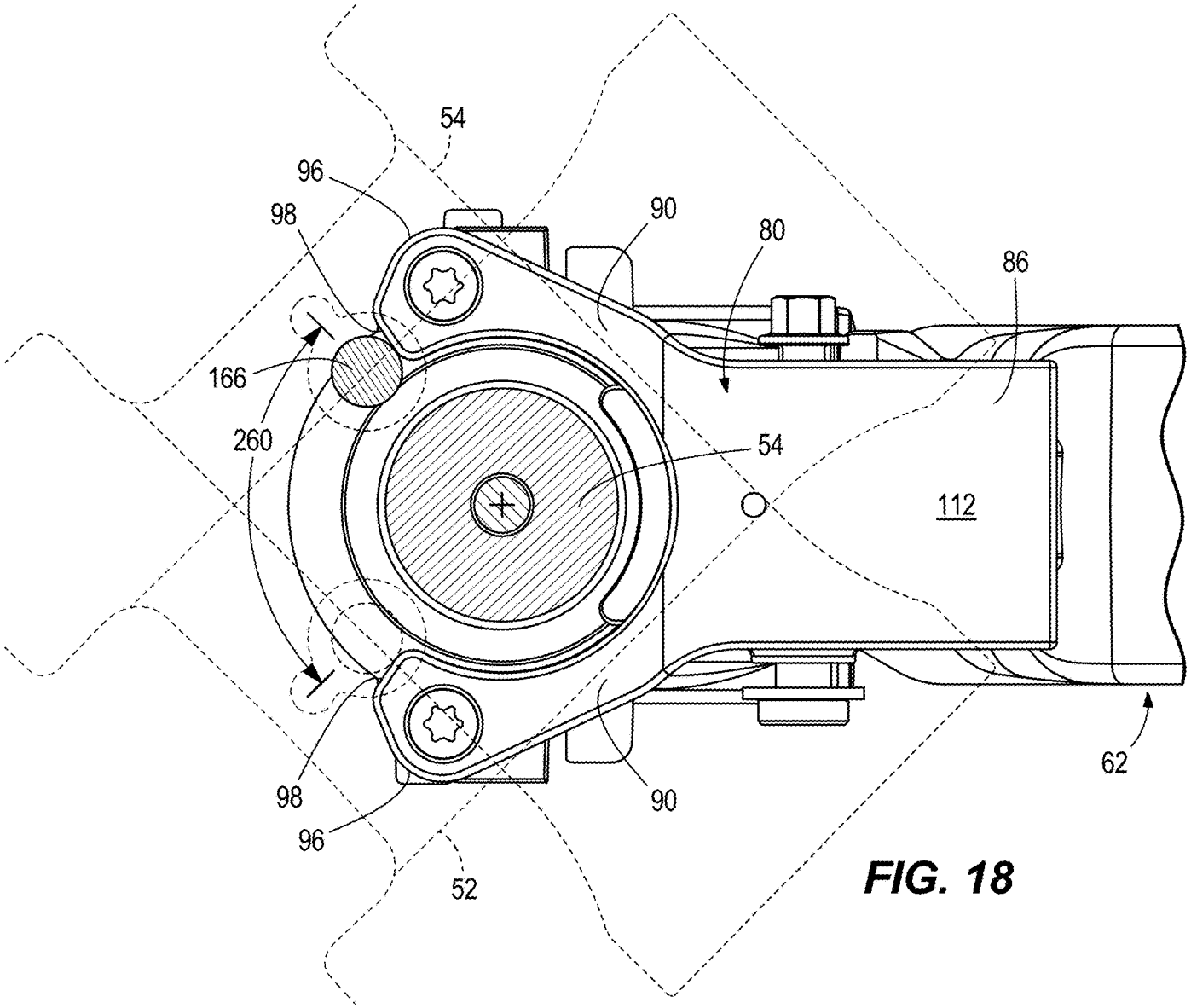
FIG. 18 is a view of section 18-18 taken in FIG. 17.

Referring to FIG. 6, the annular mouth 80 includes at least one ramp surface 90 configured to be engaged by the steering bracket assembly 50 as the swivel tube 54 is inserted into the swivel cylinder 48. In the illustrated embodiments, for example, the annular mouth 80 includes diametrically opposed ramp surfaces 90 configured for engagement by an engagement member 166 (see FIG. 8) on the steering bracket assembly 50 during insertion of the swivel tube 54 into the swivel cylinder 48. The opposing ramped surfaces 90 are merged on a first side 92 of the through-bore 88 and taper away from each other towards steering stops 96 on an opposite, second side 94 of the through-bore 88. The steering stops 96 include end surfaces 98 located about the annular mouth 80, each end surface 98 being positioned on one of the ramp surfaces 90. As illustrated in FIG. 18, the steering range 260 is defined between the end surfaces 98. Referring to FIGS. 6, 9, and 10, the body 86 of annular mouth 80 includes opposing top and bottom walls 112, 114 connected by opposing lateral side walls 116 that extend longitudinally from the through-bore 88. The top, bottom, and side walls 112, 114, 116 define an axial passage 118 extending through the annular mouth 80 from a first end 120 of the axial passage 118 that opens to the through-bore 88 to an opposite, second end 122 of the passage 118 that is aligned with and positioned proximate the axial passage 74 of the swivel arm.

In the illustrated embodiments, the marine drive 10 includes a novel locking mechanism 130 that extends through the body 86 of the annular mouth 80. The locking mechanism 130 is also configured to lock and alternately unlock the steering bracket assembly 50 relative to the transom bracket assembly 30. In a locked position of the locking mechanism 130 (FIG. 9), the locking mechanism 130 prevents removal of the steering bracket assembly 50 from the transom bracket assembly 30, thereby retaining the drive assembly 12 is on the transom bracket assembly 30 and thus on the marine vessel. In an unlocked position of the locking mechanism 130 (FIG. 10), the locking mechanism 130 permits removal of the steering bracket assembly 50 from the transom bracket assembly 30 such that the drive assembly 12 is removable from the transom bracket assembly 30 and the marine vessel.

The locking mechanism 130 includes a locking arm 132 which extends through the body 86 of the annular mouth 80 below and between the diametrically opposing ramped surfaces 90. The locking arm 132 is generally longitudinally elongated relative to the steering axis 60, extending along the swivel arm 62. The locking arm 132 includes a first, handle end 136, an opposite second, inner end 138, and a middle portion 140 between the handle end 136 and the inner end 138. The middle portion 140 of the locking arm 132 extends along the swivel arm 62, through the axial passages 74, 118 in the swivel arm 62 and the annular mouth 80. A cradle bracket 144 couples the locking arm 132 to the bottom of the top wall 72 of the swivel arm 62 so that the locking arm 132 is slidable along the swivel arm 62, radially towards and away from the swivel tube 54 The cradle bracket 144 has opposing cross-arms 146 for supporting the locking arm 132 and opposing bracket arms 148 which are fastened to the swivel arm 62 with fasteners 150 adjacent to the axial passage 74. The handle end 136 is supported by the cradle bracket 144 and includes a handle 152 that is coupled to the middle portion 140 with a fastener 154. The handle 152 extends out of the axial passage 74 and past the first end 64 of the swivel arm 62 such that the handle 152 is operable by a user to slide the locking arm 132 between the locked and unlocked positions.

With continued reference to FIGS. 6, 9 and 10, at least one lock spring 134 is positioned in the axial passage 118 of the annular mouth 80 and provides a spring force which biases the locking arm 132 into the locked position. The illustrated embodiments, for example, include two lock springs 134 positioned on opposite lateral sides of the middle section 140. In the locked position (FIG. 9), the inner end 138 of the locking arm 132 extends out of the axial passage 118 through the second end 122 and overlaps the flange 56 of the swivel tube 54 to prevent removal of the swivel tube 54 from the swivel cylinder 48. When the locking arm 132 is moved into the unlocked position (FIG. 10), the inner end 138 recedes into the body 86 of the annular mouth 80 such that the inner end 138 no longer overlaps the flange 56 and the swivel tube 54 may be from the swivel cylinder 48. A pin 156 extends vertically between the top and bottom walls 112, 114 of the body 86 and engages a slot 160 formed through the inner end 138 of the locking arm 132. Engagement of the slot 160 by the pin 156 retains the locking arm in the axial passage 118 and may act as a stop defining at the locked position and/or the unlocked position of the locking arm 132. The inner end 138 includes a ramp surface 162 which is configured engaged by the flange 56 as the swivel tube 54 is inserted into the swivel cylinder 48, and engagement of the ramp surface 162 by the flange 56 cams the locking arm 132 out of the locked position against the spring force of the lock springs 134.

Referring to FIG. 7, the lower end 184 of the swivel cylinder 48 includes an opening 186 that is scaled by a bolt 188. A washer 189 is arranged on the bolt 188 between the bolt head and the lower edge of the swivel cylinder 48. A return spring 190 is disposed in the lower end 184 of the swivel cylinder 48, and an end cap 192 on the return spring 190 is configured to operatively engage a lower end 178 of the swivel tube 54 in the swivel cylinder 48. As further discussed below, the return spring 190 has a spring force sufficient to move the swivel tube 54 outwardly relative to the swivel cylinder 48 when the locking arm 132 is moved from the locked position to the unlocked position. Thus, as part of a novel quick release mechanism, the return spring 190 is configured to eject the swivel tube assembly 55 from the swivel cylinder 48 when the locking mechanism 130 is moved into the unlock position.

Figure 8:
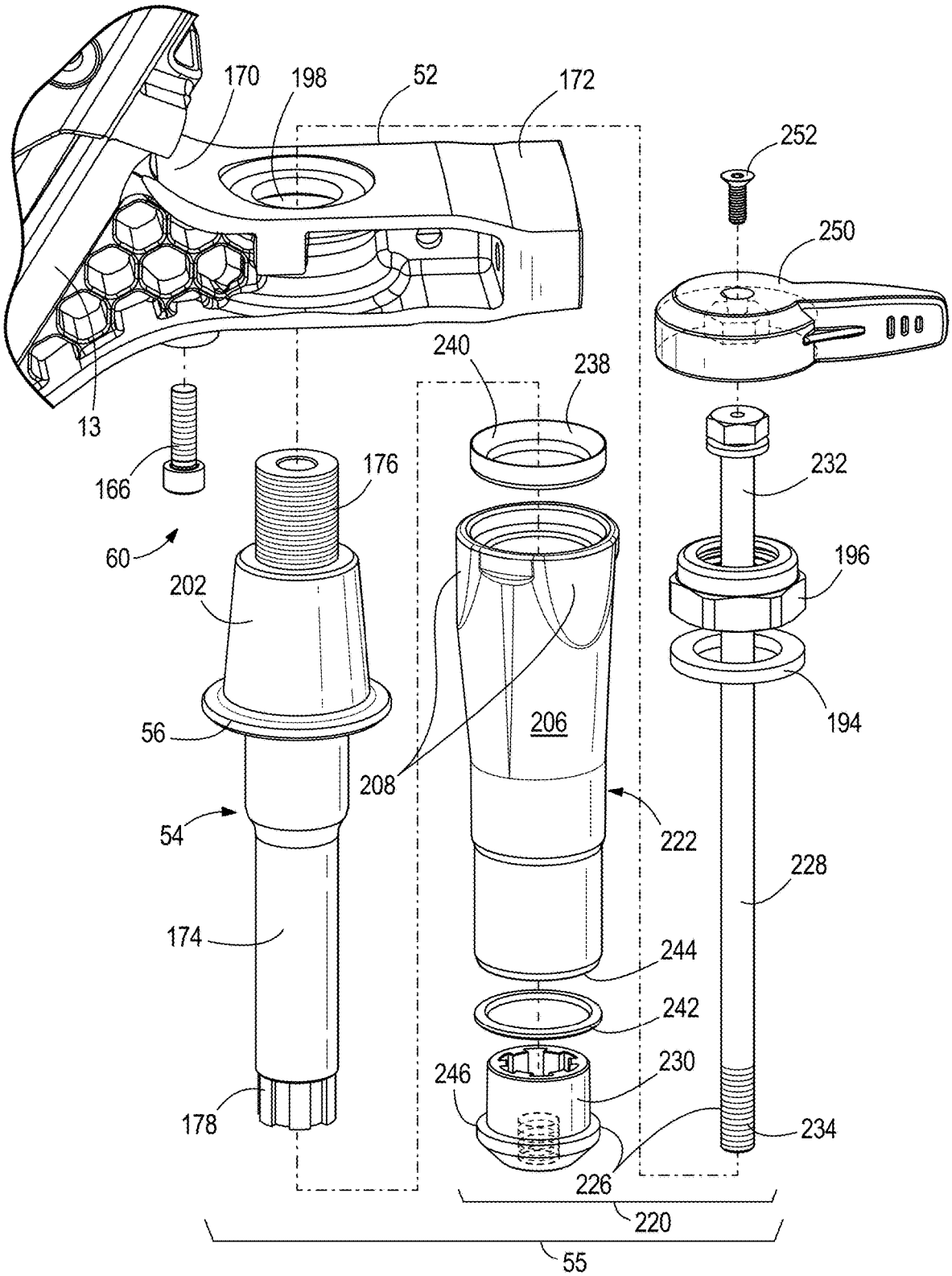
FIG. 8 is an exploded perspective view of the steering bracket assembly of FIG. 4.

Referring now to FIG. 8, the steering bracket assembly 50 has a steering arm 52 and a swivel tube assembly 55. The steering arm 52 has a first end 170 which is fixed to a supporting frame 13 or other component of the marine drive 10 and an opposite, second end 172 configured to be coupled to a manually operable tiller 58. The steering bracket assembly 50 includes an engagement member 166, for example a bolt in the illustrated embodiments, that is spaced apart from the swivel tube 54 and extends transversely from the steering arm 52 in a downward direction proximate the first end 170. As discussed in detail with respect to FIGS. 16-18, the engagement member 166 is configured to engage the annular mouth 80 as the swivel tube 54 is inserted into the swivel cylinder 48, thereby causing the steering bracket assembly 50 to rotate about the steering axis 60 into alignment with the steering range 260.

Figure 14:
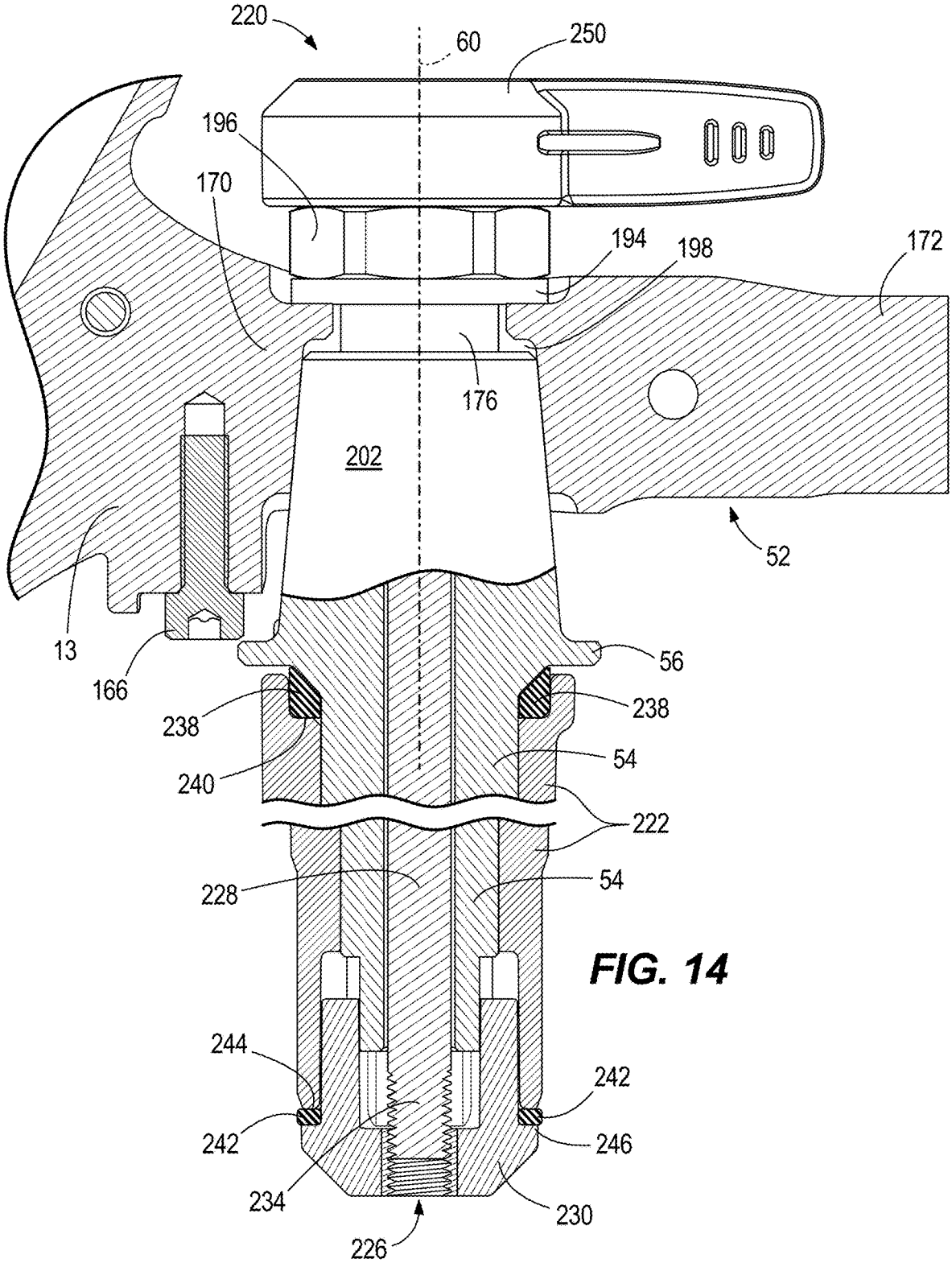
FIG. 14 is another view of section 9-9 with the copilot device in a disengaged position.
Figure 15:
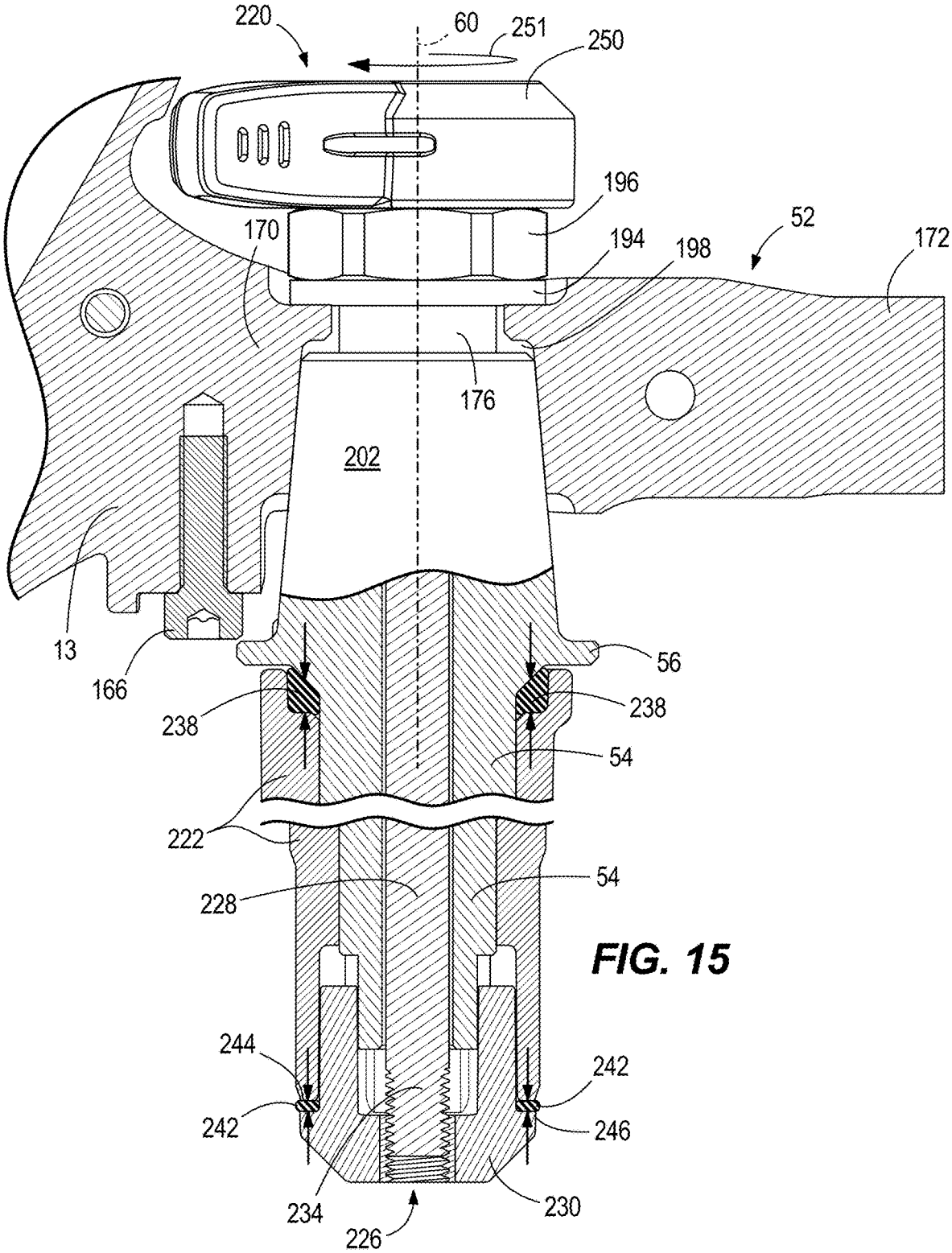
FIG. 15 is another view of section 9-9 with the copilot device rotating to compress friction members to restrict rotation of the steering bracket assembly.

Referring to FIGS. 8, 14 and 15, the swivel tube assembly 55 includes the swivel tube 54 and a novel copilot device 220 that is at least partially disposed in the swivel tube 54 and configured to restrain rotation of the swivel tube 54 relative to the transom bracket 32. The swivel tube 54 is generally cylindrical, having a smooth outer surface 174 which extends generally downward along the axial direction from the steering arm 52. An upper end 176 of the swivel tube 54 is fixed to a middle portion of the steering arm 52, and a lower end 178 of the swivel tube 54 is disposed within the swivel cylinder 48. In particular, the upper end 176 of the swivel tube 54 extends through a through-bore 198 in the steering arm 52 and is coupled to the steering arm 52 by a washer 194 and threaded nut 196. A smooth frustoconical portion 202 abuts the inner surface of the through-bore 198, and a friction fit between the frustoconical portion 202 and the through-bore 198 prevents rotation of the swivel tube 54 in the through-bore 88. Thus, the swivel tube 54 is fixed to the steering arm 52 such that manually steering the tiller 58 about the steering axis 60 rotates the steering arm 52 and the swivel tube 54 together about the steering axis 60.

Figure 5:
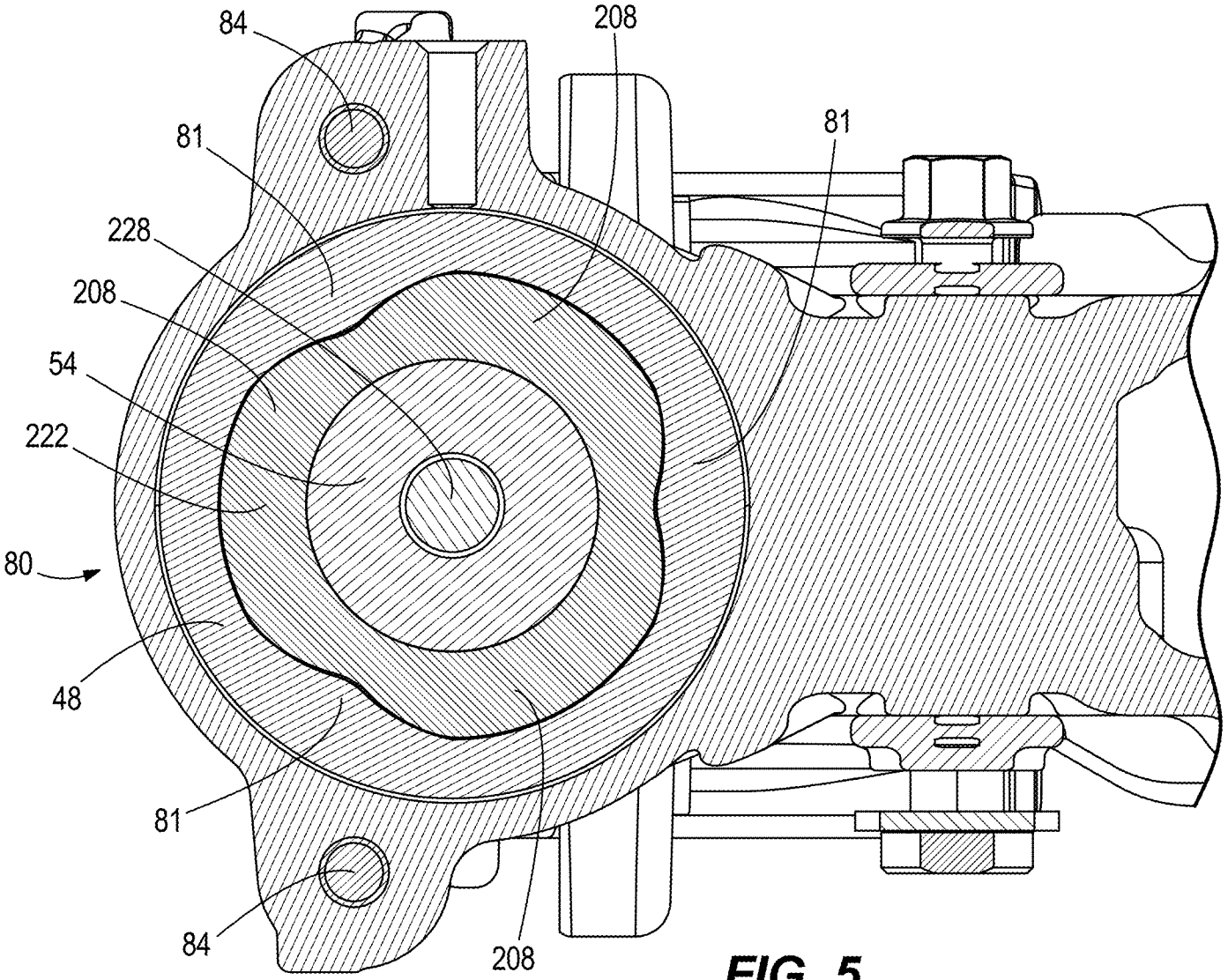
FIG. 5 is a view of section 5-5 taken in FIG. 3.

The copilot device 220 includes a sleeve 222 that is disposed on and rotatable about the swivel tube 54, which is coaxial with and disposed within the sleeve 222. The sleeve 222 remains stationary relative to the steering axis 60 due to the noted nested engagement between sleeve 222 and the annular mouth 80 and the swivel cylinder 48. In particular, the sleeve 222 has an eccentric outer surface 206 including three tapered alignment protrusions 208 spaced around the upper end 224 of the sleeve 222. As illustrated in FIG. 5, the shape of the eccentric outer surface 206 of the sleeve 222 is complementary to the shape of the inner surface 49 of the swivel cylinder 48 and the centering members 81. During insertion of the swivel tube 54, engagement between the tapered alignment protrusion 208 and the centering members 81 funnels the swivel tube assembly 55 into the center of the swivel cylinder 48. Advantageously, the alignment protrusions 208 and the centering members 81 are symmetrically spaced around the steering axis 60 so that the swivel tube assembly 55 may be inserted into the swivel cylinder 48 in any orientation. Once inserted, nested engagement between the eccentric outer surface 206 and the inner surface 49 of the swivel cylinder 48 prevents rotation of the sleeve 222 relative to the swivel cylinder 48.

Referring to FIGS. 8, 14, and 15, the copilot device 220 includes an actuator 226 with an actuator arm 228 extending coaxially through the swivel tube 54 and sleeve 222 and a nut 230 on a lower end 234 of the actuator arm 228. The actuator arm 228 of the copilot device 220 has an upper end 232 which protrudes from an upper end 176 of the swivel tube 54. The lower end 234 of the actuator arm 228 protrudes from a lower end 178 of the swivel tube 54, and the nut 230 extends past a bottom end of the sleeve 222 such that the lower end of the copilot device 220 is disposed in the swivel cylinder 48. An upper friction member 238 is disposed on the cylindrical portion of the swivel tube 54 and is sandwiched between the flange 56 of the swivel tube 54 and an annular upper flange surface 240 of the sleeve 222. A lower friction member 242 is disposed on the swivel tube 54 proximate the lower end 178 thereof. The lower friction member 242 is sandwiched between a lower edge 244 of the sleeve 222 and an annular flange 246 of the nut 230.

The copilot device 220 includes a handle 250 a handle for actuating the copilot device 220. The handle 250 is located at the upper end 176 of the swivel tube 54 and is coupled to the upper end 232 of the actuator arm 228 by a fastener 252. The handle 250 may be operated by a user to rotate the actuator arm 228. The nut 230 is engaged with the actuator arm 228 via a threaded connection such that rotation of the actuator arm 228 causes the nut 230 to axially travel along the actuator arm 228. Rotating the actuator arm 228 in a first direction indicated by arrow 251 in FIG. 15 causes the nut 230 to axially travel along the actuator arm 228 in a first direction. Rotating the actuator arm 228 arm in an opposite, second direction causes the nut 230 to axially travel along the actuator arm 228 in an opposite, second direction. As described in further detail below, movement of the nut 230 in the first direction moves the sleeve 222 against the friction members 238, 242, which thereby frictionally engages and restrains rotation of the swivel tube 54 relative to the sleeve 222 and the swivel bracket 34.

To mount the marine drive 10 on the transom bracket assembly 30, the swivel tube assembly 55 is lowered into the swivel cylinder 48 through the opening 78 of the swivel cylinder 48 and the through-bore 88 of the annular mouth 80, as shown by dash-and-dot line in FIG. 4. As the swivel tube assembly 55 is lowered into the swivel cylinder 48, the alignment protrusions 208 on the sleeve 222 engage the centering members 81 of the annular mouth 80, thereby funneling the swivel tube assembly 55 into the center of the swivel cylinder 48 and rotating the sleeve 222 so that the outer surface 206 of the swivel tube assembly 55 is nested against the inner surface 49 of the swivel cylinder 48. Advantageously, the self-aligning arrangement of the sleeve 222 allows a user to insert the swivel tube assembly 55 into the swivel cylinder 48 in any orientation without manually rotating the sleeve 222 into alignment with the eccentric inner surface 49 of the swivel cylinder 48.

Figure 16:
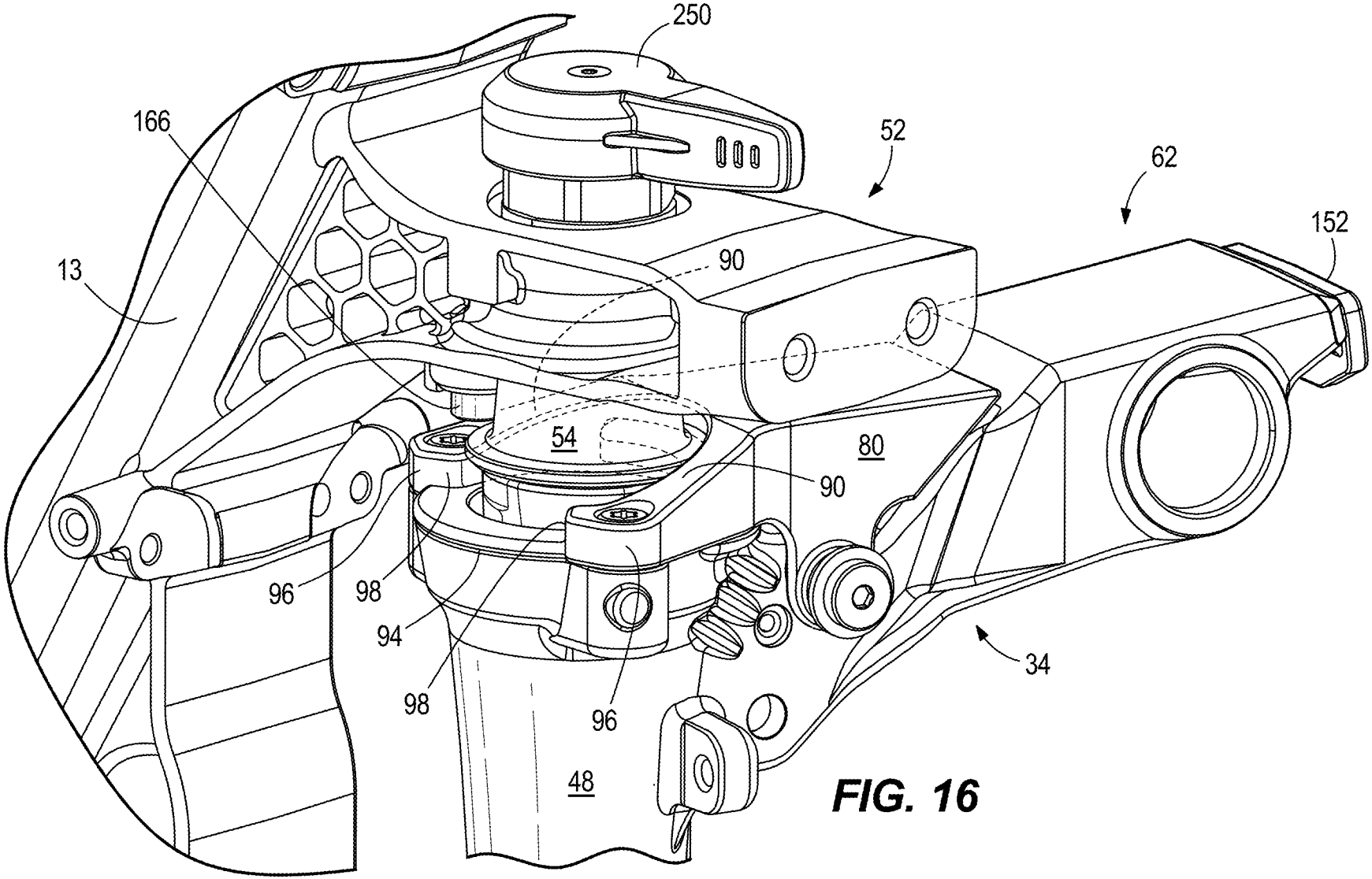
FIG. 16 is a detailed perspective view of the steering bracket assembly and the swivel bracket of FIG. 3 with the steering bracket assembly slidably engaged with a ramped surface.
Figure 17:
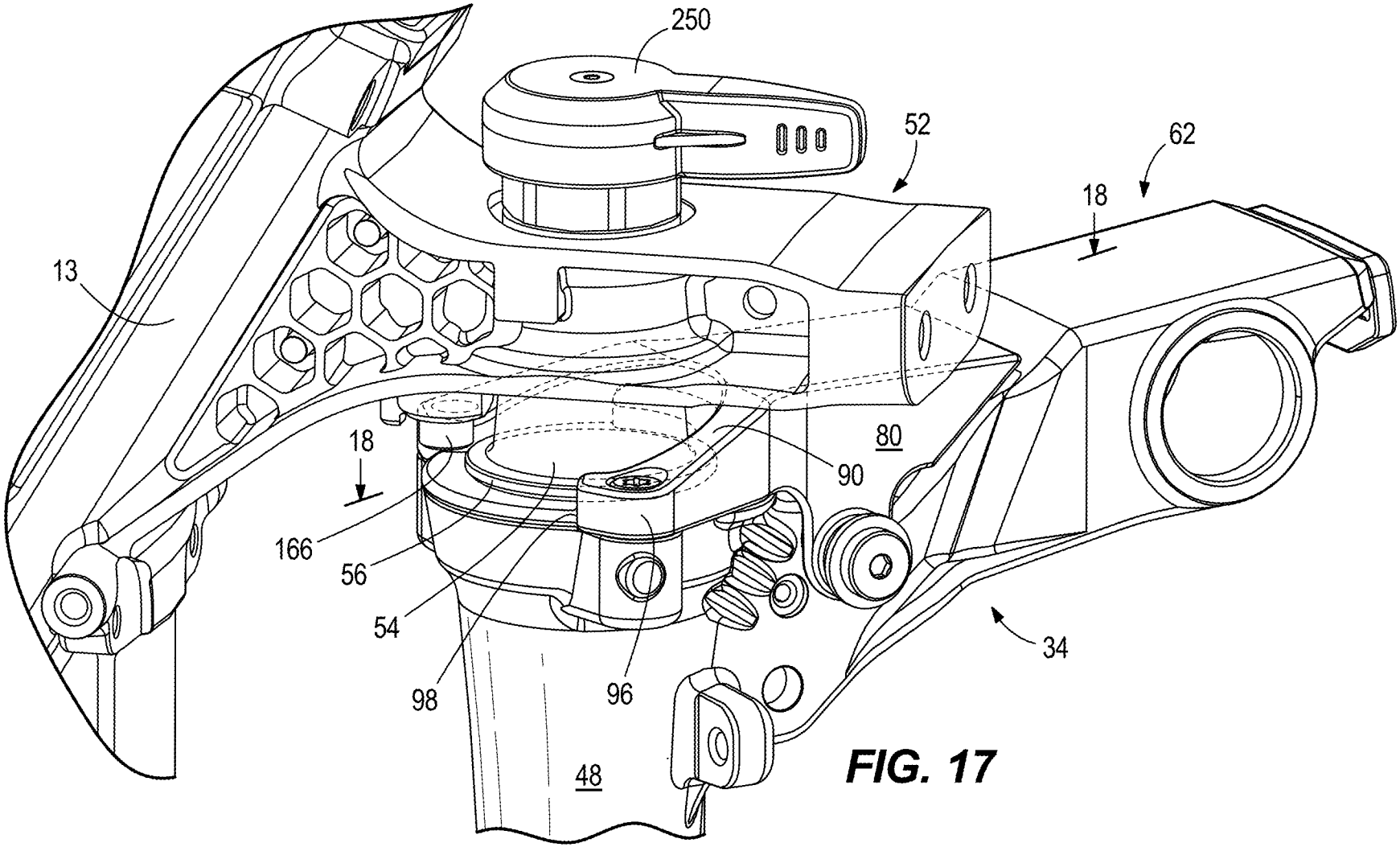
FIG. 17 is the detailed perspective view of FIG. 16, with the engagement member of the steering bracket assembly between the steering stops of the swivel bracket.

Referring to FIGS. 16-18, the engagement member 166 is configured to operably engage the annular mouth 80, thereby causing the steering bracket assembly 50 to rotate into alignment with the steering range 260 defined by the steering stops 96. As the swivel tube assembly 55 is inserted into the swivel cylinder 48, the engagement member 166 of the steering bracket assembly 50 engages and slides along one of the ramped surfaces 162. The ramped surfaces 162 slope downward towards the second end 94 of the through-bore 88 of the annular mouth 80, which thereby causes the steering bracket assembly 50 to rotate into alignment with the steering range 260. Thus, the steering bracket assembly 50 is self-aligning and does not need to be manually oriented with the steering range 260 before the swivel stube assembly 55 is inserted into the swivel cylinder 48.

Figure 11:
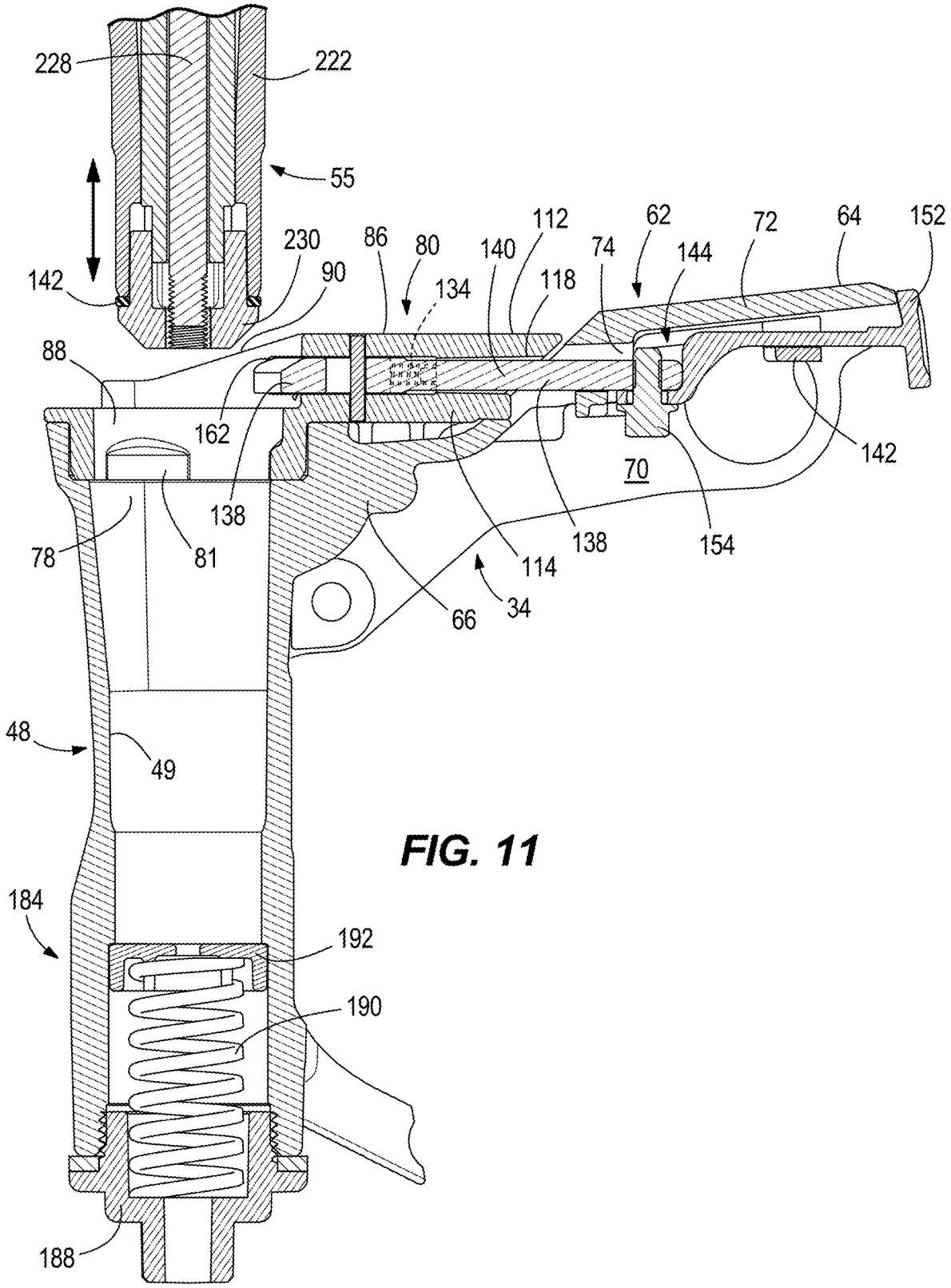
FIG. 11 is another view of section 9-9 with swivel tube assembly removed from the swivel cylinder.
Figure 12:
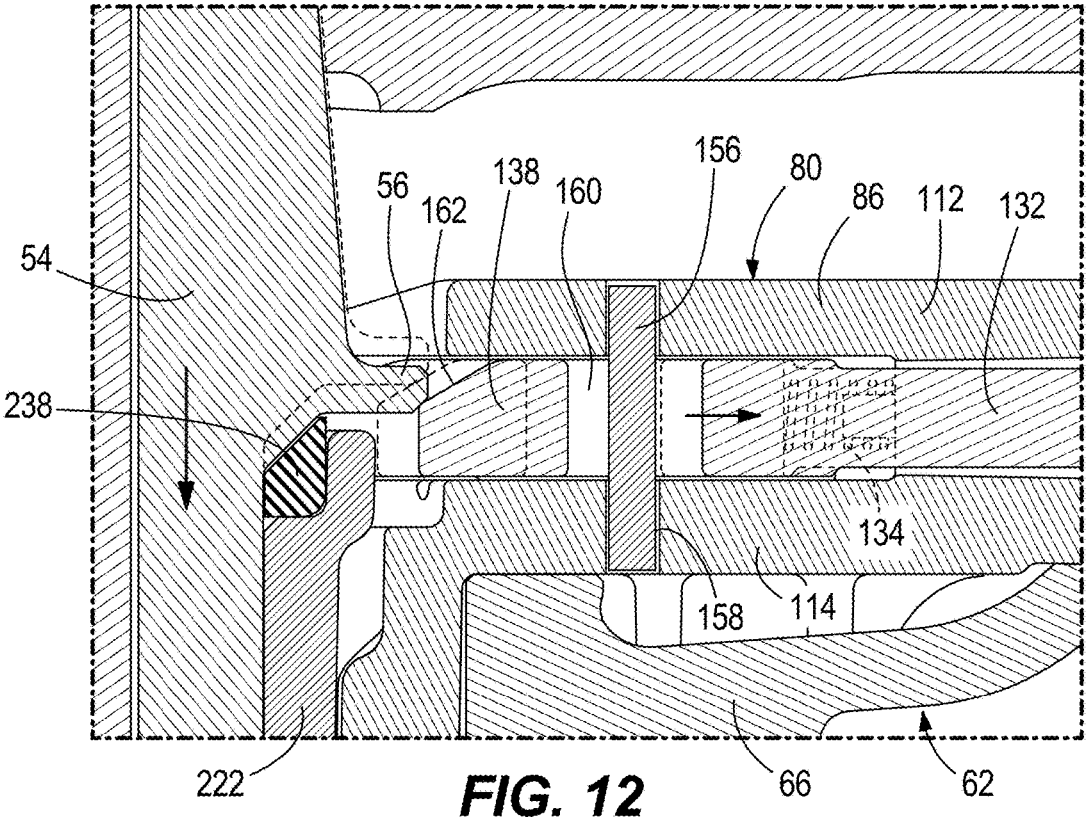
FIG. 12 is a detailed view of the locking mechanism in section 9-9 which depicts the insertion of the swivel tube into the swivel cylinder.
Figure 13:
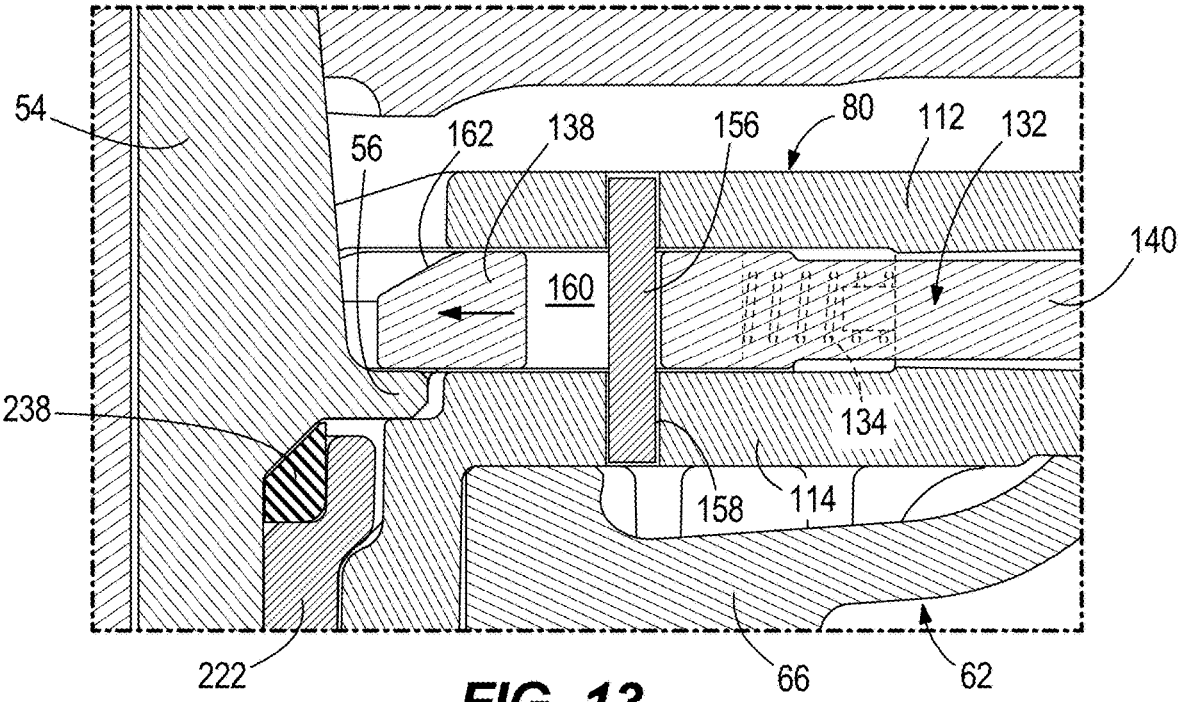
FIG. 13 is the detailed view of FIG. 12 depicting the locking mechanism returning to the locked position.

Referring to FIGS. 11-13, further insertion of the swivel tube assembly 55 into the swivel cylinder 48 moves the flange 56 of the swivel tube 54 into abutment with the inner end 138 of the locking arm 132. As the swivel tube assembly 55 is lowered, the flange 56 of the swivel tube 54 engages the ramp surface 162 of the locking arm 132. As illustrated in FIG. 12, engagement between the flange 56 and the ramp surface 162 pushes the locking arm 132 into the unlocked position against the force of the lock springs 134. As illustrated in FIG. 13, after the flange 56 has moved past the ramp surface 162, the lock springs 134 move the locking arm 132 into the locked position to prevent removal of the swivel tube 54 from the swivel cylinder 48. As the lower end of the swivel tube assembly 55 reaches the lower end 184 of the swivel cylinder 48, the nut 230 of the copilot device 220 engages and compresses the return spring 190. The swivel tube assembly 55 is supported on the end cap 192 of the return spring 190. The return spring 190 biases the swivel tube assembly 55 upward in the swivel cylinder 48, thereby pressing the upper surface of the flange 56 against the inner end 138 of the locking arm 132.

To remove the swivel tube assembly 55 from the swivel cylinder 48, the handle 152 of the locking mechanism 130 can be operated to move the locking arm 132 into the unlocked position. Referring to FIGS. 9 and 10, operating the handle 152 by pulling it in the direction of the arrow 153 slides the inner end 138 radially away from steering axis 60 defined by the swivel tube 54 and into the unlocked position. Once the locking mechanism 130 is in the unlocked position, the inner end 138 no longer overlaps the flange 56 and the return spring 190 pushes the swivel tube assembly 55 upward in the direction of arrow 191 in FIG. 10. The spring force of the return spring 190 is sufficient to move the swivel tube 54 (with the connected drive assembly 12) outwardly relative to the swivel cylinder 48 a distance sufficient to move the flange 56 past the inner end 138 of the locking arm 132. Thus, the locking mechanism 130 and return spring 190 advantageously provide a quick detach mechanism that ejects the steering bracket assembly 50 from the transom bracket assembly 30. Releasing the handle 152 of the locking mechanism 130 permits the lock spring 134 to bias the locking arm 132 back towards the locked position.

Once the swivel tube assembly 55 is fully inserted into the swivel cylinder 48, the engagement member 166 is thereafter configured to engage the end surfaces 98 of the opposing steering stops 96, which prevents steering of the marine drive 10 beyond the steering range 260. Steering the marine drive 10 in a first direction about the steering axis 60 brings the engagement member 166 into abutment with a first one of the end surfaces 98. Steering of the marine drive 10 in an opposite, second direction about the steering axis 60 brings the engagement member 166 into abutment with a second one of the end surfaces 98. In the illustrated embodiments, the steering range 260 extends only part way about the steering axis 60. Other embodiments, however, may be configured with a steering range that is wider or narrower than that of the illustrated embodiment. Further still, some embodiments may be configured without steering stops.

The copilot device 220 can be operated to selectively hold the steering bracket assembly 50 in a selected steering orientation about the steering axis 60. Referring to FIGS. 14 and 15, the copilot handle 250 can be rotated to adjust the friction between the swivel tube 54 and the sleeve 222 that is provided by the friction members 238, 242. Operating the handle 250 to rotate the actuator arm 228 in the first direction indicated by arrow 251 causes the nut 230 to slide the sleeve 222 upward along the swivel tube 54 so as to engage the friction members 238, 242 against the swivel tube 54, thereby restraining rotation of the swivel tube 54 in the swivel cylinder 48. As best illustrated in FIG. 15, upward movement of the nut 230 compresses the upper friction member 238 between the lower surface of the flange 56 of the swivel tube 54 and the annular upper flange surface 240 of the sleeve 222, and the lower friction member 242 is compressed between the lower edge 244 of the sleeve 222 and the annular flange 246 of the nut 230. Frictional engagement of the friction members 238, 242 with the swivel tube 54 and the sleeve 222 resists or prevents steering movement of the steering bracket assembly 50 and connected marine drive 10 relative to the transom bracket assembly 30. Operating the handle 250 to rotate the actuator arm 228 in the opposite, second direction causes the nut 230 to permit the sleeve 222 to slide downward along the swivel tube 54 so as to disengage the friction members 238, 242 from the swivel tube 54, thereby permitting rotation of the swivel tube 54 in the swivel cylinder 48.

Advantageously, the copilot device 220 provides the ability to selectively vary an amount of resistance against steering motions of the steering bracket assembly 50 relative to the transom bracket assembly 30. The degree of rotation of the handle 250 corresponds to the amount of axial movement of the nut 230 and the compressive force exerted on the upper and lower friction members 238, 242. Rotating the handle 250 in the first direction increases the strength of frictional engagement between the friction members 238, 242 and the swivel tube 54 and sleeve 222. Rotating the handle 250 in the second direction decreases the strength of frictional engagement between the friction members 238, 242 and the swivel tube 54 and sleeve 222. Thus, the copilot device 220 permits the user to control the degree of resistance to steering movements of the marine drive 10 via the tiller 58, for example, according to personal preference. Some users prefer more resistance to steering inputs than others, as a personal choice. The copilot device advantageously permits this characteristic to be selectively varied and set by the user.

This written description uses examples to disclose the invention, including the best mode, and to enable any person skilled in the art to make and use the invention. Certain terms have been used for brevity, clarity and understanding. No unnecessary limitations are to be inferred therefrom beyond the requirement of the prior art because such terms are used for descriptive

What is claimed is:

1. An apparatus for removably supporting a marine drive on a marine vessel, the apparatus comprising:

a transom bracket assembly having a swivel cylinder;

a steering bracket assembly having a swivel tube;

a locking mechanism that is movable into a locked position in which the locking mechanism retains the swivel tube in the swivel cylinder to prevent removal of the steering bracket assembly from the transom bracket assembly, and into an unlocked position in which removal of the steering bracket assembly from the transom bracket assembly is permitted; and a return spring configured to move the swivel tube outwardly relative to the swivel cylinder when the locking mechanism is moved from the locked position to the unlocked position.

2. The apparatus according to claim 1, further comprising a lock spring that biases the locking mechanism towards the locked position.

3. The apparatus according to claim 2, wherein the locking mechanism has a handle, wherein operation of the handle moves the locking mechanism into the unlocked position, and wherein releasing the handle permits the lock spring to bias the locking arm-mechanism towards the locked position.

4. The apparatus according to claim 1, wherein the locking mechanism includes a locking arm and the swivel tube includes a flange, and wherein the locking arm in the locked position blocks the flange to prevent removal of the swivel tube from the swivel cylinder.

5. The apparatus according to claim 4, wherein the return spring is configured to move the flange past the locking arm when the locking arm is moved from the locked position to the unlocked position.

6. The apparatus according to claim 4, further comprising a lock spring that biases the locking mechanism towards the locked position, wherein the locking arm has a ramp surface that is engaged by the flange as the swivel tube is inserted into the swivel cylinder, and wherein engagement of the ramp surface by the flange cams the locking arm out of the locked position against a bias of the lock spring.

7. The apparatus according to claim 4, further comprising a lock spring that biases the locking mechanism towards the locked position, wherein insertion of the swivel tube into the swivel cylinder moves the flange past the locking arm, which permits a lock spring to move the locking arm into the locked position to prevent removal of the swivel tube from the swivel cylinder.

8. The apparatus according to claim 4, wherein moving the locking arm into the unlocked position causes the return spring to move the swivel tube outwardly relative to the swivel cylinder a distance sufficient to move the flange past the locking arm.

9. The apparatus according to claim 1, wherein the return spring is located in the swivel cylinder and operably engages a lower end of the swivel tube.

10. The apparatus according to claim 1, wherein the return spring is located at a bottom of the swivel cylinder.

11. The apparatus according to claim 1, further comprising an end cap on the return spring, the end cap being configured to engage a lower end of the swivel tube.

12. An apparatus for removably supporting a marine drive on a marine vessel, the apparatus comprising:

a transom bracket assembly configured for attachment to the marine vessel, the transom bracket assembly having a swivel cylinder;

a steering bracket assembly configured for attachment to the marine drive, the steering bracket assembly having a steering arm and a swivel tube coupled to the steering arm, the swivel tube being located in and steerable relative to the swivel cylinder to facilitate steering of the marine drive relative to the marine vessel; and a copilot device configured to restrain rotation of the swivel tube relative to the transom bracket assembly, wherein the copilot device is located at least partially in the swivel tube.

13. The apparatus according to claim 12, wherein the copilot device protrudes from an upper end of the swivel tube.

14. The apparatus according to claim 12, further comprising a handle for actuating the copilot device, the handle being located at an upper end of the swivel tube.

15. The apparatus according to claim 12, wherein the copilot device includes a sleeve on the swivel tube, the sleeve being rotatable about the swivel tube, the sleeve being rotationally locked relative to the swivel cylinder, a friction member, and an actuator configured to move the sleeve against the friction member, which frictionally engages and restrains rotation of the swivel tube relative to the sleeve.

16. The apparatus according to claim 15, wherein the actuator includes an actuator arm extending through the swivel tube, the actuator arm having an upper end and a lower end, wherein the lower end is located in the swivel cylinder.

17. The apparatus according to claim 16, wherein the actuator further includes a nut on an end of the actuator arm, the nut being engaged with the actuator arm via a threaded connection such that rotation of the actuator arm in a first direction causes the nut to axially travel along the actuator arm in a first direction and such that rotation of the actuator arm in an opposite, second direction causes the nut to axially travel along the actuator arm in an opposite, second direction.

18. The apparatus according to claim 17, wherein rotation of the actuator arm in the first direction causes the nut to slide the sleeve along the swivel tube so as to engage the friction member against the swivel tube to restrain rotation of the swivel tube in the swivel cylinder, and further wherein rotation of the actuator arm in the opposite, second direction causes the nut to permit the sleeve to slide along the swivel tube so as to disengage the friction member from the swivel tube to permit rotation of the swivel tube in the swivel cylinder.

19. An apparatus for removably supporting a marine drive on a marine vessel, the apparatus comprising:

a transom bracket assembly having a swivel cylinder;

a steering bracket assembly having a swivel tube located in and steerable relative to the swivel cylinder;

a locking mechanism configured to retain the swivel tube in the swivel cylinder, wherein the locking mechanism includes a locking arm which overlaps a flange on the swivel tube in a locked position to thereby prevent removal of the steering bracket assembly from the transom bracket assembly, and which is withdrawn from the flange in an unlocked position to thereby permit removal of the steering bracket assembly from the transom bracket assembly;

a return spring having a spring force sufficient to move the swivel tube outwardly relative to the swivel cylinder when the locking arm is moved from the locked position to the unlocked position; and a copilot device is configured to restrain rotation of the swivel tube relative to the transom bracket assembly, wherein the copilot device is located at least partially in the swivel tube.

* * * * *